US008382065B2

(12) United States Patent
Hendrickson et al.

(10) Patent No.: US 8,382,065 B2
(45) **Date of Patent: *Feb. 26, 2013**

(54) SUBSTANCE COMMUNICATING DEVICE WITH MECHANICALLY ENERGIZED CONNECTOR SYSTEM

(75) Inventors: Michael S. Hendrickson, St. Joseph, MI (US); Joel A. Luckman, Benton Harbor, MI (US); Richard A. McCoy, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 508 days.

This patent is subject to a terminal disclaimer.

(21) Appl. No.: 12/643,366

(22) Filed: Dec. 21, 2009

(65) Prior Publication Data

US 2011/0146819 A1 Jun. 23, 2011

(51) Int. Cl.
*F16L 37/38* (2006.01)
*H01R 4/60* (2006.01)
*B65B 1/04* (2006.01)

(52) U.S. Cl. ..... 251/149; 141/347; 141/349; 141/351; 439/190

(58) Field of Classification Search ..... 439/190–191, 439/198–199; 251/149, 142, 148; 141/347, 141/349, 351, 198, 192; 200/52 R, 61.58 R, 200/61.6, 61.85, 61.86, 51 R
See application file for complete search history.

(56) References Cited

U.S. PATENT DOCUMENTS

| | | | | |
|---|---|---|---|---|
| 1,958,206 | A | | 5/1934 | Rubsam |
| 3,101,984 | A | | 8/1963 | Wieckmann |
| 3,258,553 | A | * | 6/1966 | Breslin ..... 200/51 R |
| 4,148,536 | A | | 4/1979 | Petropoulsos et al. |
| 4,591,732 | A | | 5/1986 | Neuenschwander |
| 4,604,505 | A | | 8/1986 | Henninger |
| 5,031,258 | A | | 7/1991 | Shaw |
| 5,385,468 | A | | 1/1995 | Verderber |
| 5,433,623 | A | | 7/1995 | Wakata et al. |
| 5,713,752 | A | | 2/1998 | Leong et al. |
| 6,176,718 | B1 | | 1/2001 | Skarie et al. |
| 6,350,148 | B1 | | 2/2002 | Bartolutti et al. |
| 6,359,270 | B1 | | 3/2002 | Bridson |
| 6,428,334 | B1 | | 8/2002 | Skarie et al. |
| 6,534,951 | B2 | | 3/2003 | Kawashima |

(Continued)

FOREIGN PATENT DOCUMENTS

| | | |
|---|---|---|
| EP | 0868077 A2 | 9/1998 |
| JP | 60033716 A | 2/1985 |

(Continued)

*Primary Examiner* — Eric Keasel
*Assistant Examiner* — David Colon Morales
(74) *Attorney, Agent, or Firm* — Clifton G. Green; McGarry Bair PC

(57) ABSTRACT

Systems and components for providing or receiving a service through a service connector system. A first substance communicating device has a first service connector component and a first switch component. A second substance communicating device has a second service connector component operably actuatable by the first service connector component to permit the communication of a service between the first and second service connector components. One of the substance communicating devices further has a second switch component operably associated with the second service connector component, the second switch component being configured to be actuatable by the first switch component when the first service connector component is adjacent the second service connector component to selectively draw the first and second service connector components into engagement to permit the communication of the service between the substance communicating devices.

30 Claims, 5 Drawing Sheets

U.S. PATENT DOCUMENTS 6,559,882 B1 5/2003 Kerchner
6,685,491 B2 * 2/2004 Gergek ..... 439/191
6,969,928 B2 11/2005 Hanson
6,981,695 B1 1/2006 Hedlund et al.
7,024,717 B2 4/2006 Hilscher et al.
7,207,080 B2 4/2007 Hilscher et al.
7,209,038 B1 4/2007 Deconinck et al.
7,291,032 B1 11/2007 Carver et al.
7,354,292 B1 4/2008 Lloyd et al.
7,404,298 B2 7/2008 Kim et al.
7,493,926 B2 2/2009 Weglin
7,584,030 B1 9/2009 Graham
7,618,295 B2 11/2009 McCoy
7,625,246 B2 12/2009 McCoy et al.
7,639,485 B2 12/2009 McCoy
7,651,368 B2 1/2010 Kendall et al.
7,686,127 B2 3/2010 LeClear et al.
7,713,090 B2 5/2010 Kendall et al.
7,740,505 B2 6/2010 McCoy
7,740,506 B2 6/2010 McCoy
7,748,494 B2 7/2010 LeClear et al.
7,751,184 B2 7/2010 McCoy
7,765,332 B2 7/2010 McCoy et al.
7,798,865 B2 9/2010 McCoy et al.
7,810,343 B2 10/2010 McCoy et al.
7,826,203 B2 11/2010 McCoy
7,841,907 B2 11/2010 McCoy
7,843,697 B2 11/2010 McCoy et al.
7,852,619 B2 12/2010 McCoy
7,865,639 B2 1/2011 McCoy et al.
7,869,201 B2 1/2011 McCoy et al.
7,870,753 B2 1/2011 Marcy et al.
7,871,300 B2 1/2011 McCoy et al.
7,898,812 B2 3/2011 McCoy et al.
7,903,397 B2 3/2011 McCoy
7,916,336 B2 3/2011 Silverbrook et al.
7,931,114 B2 4/2011 LeClear et al.
7,934,958 B2 5/2011 Kendall et al.
7,980,088 B2 7/2011 LeClear et al.
8,008,586 B2 8/2011 Kuehl et al.
8,035,958 B2 10/2011 Kendall et al.
8,040,666 B2 10/2011 McCoy et al.
8,151,016 B2 * 4/2012 McCoy ..... 710/33
2003/0037447 A1 * 2/2003 Gruber et al. ..... 30/537
2003/0154338 A1 8/2003 Boz et al.
2004/0036273 A1 2/2004 McClary
2004/0154318 A1 8/2004 Roh et al.
2005/0011205 A1 1/2005 Holmes et al.
2006/0053655 A1 * 3/2006 Weglin ..... 36/3 B
2006/0118694 A1 6/2006 Lee et al.
2006/0125360 A1 6/2006 Kim et al.
2006/0168236 A1 7/2006 Higuma et al.
2007/0086151 A1 4/2007 Oh et al.
2008/0065289 A1 3/2008 Bertosa et al.
2008/0164224 A1 7/2008 McCoy et al.
2008/0164225 A1 7/2008 McCoy
2008/0164226 A1 7/2008 McCoy et al.
2008/0164227 A1 7/2008 LeClear et al.
2008/0164796 A1 7/2008 McCoy et al.
2008/0165282 A1 7/2008 Marcy et al.
2008/0165474 A1 7/2008 McCoy et al.
2008/0165475 A1 7/2008 McCoy et al.
2008/0165476 A1 7/2008 McCoy et al.
2008/0165478 A1 7/2008 McCoy
2008/0165505 A1 7/2008 McCoy et al.
2008/0165509 A1 7/2008 Kendall et al.
2008/0165998 A1 7/2008 LeClear et al.
2008/0166895 A1 7/2008 McCoy et al.
2008/0166915 A1 7/2008 Kendall et al.
2008/0168205 A1 7/2008 McCoy et al.
2008/0192411 A1 8/2008 McCoy
2008/0201032 A1 8/2008 Fayyad et al.
2008/0222327 A1 9/2008 McCoy et al.
2008/0231464 A1 9/2008 Lewis et al.
2008/0231764 A1 9/2008 Kendall et al.
2008/0232053 A1 9/2008 Kendall et al.
2008/0247141 A1 10/2008 Kendall et al.
2008/0287009 A1 11/2008 McCoy
2009/0009316 A1 1/2009 Kendall et al.
2009/0047824 A1 2/2009 Seibert et al.
2009/0054804 A1 2/2009 Gharib et al.
2010/0120284 A1 5/2010 Oka et al.
2010/0182753 A1 7/2010 Kendall et al.
2010/0248546 A1 9/2010 McCoy
2011/0049308 A1 3/2011 Beaman et al.
2011/0146328 A1 6/2011 Hendrickson et al.
2011/0146329 A1 6/2011 Kuehl et al.
2011/0146330 A1 6/2011 Kuehl et al.
2011/0146819 A1 6/2011 Hendrickson et al.
2011/0147159 A1 6/2011 Kuehl et al.
2011/0147160 A1 6/2011 Kuehl et al.
2011/0147161 A1 6/2011 Kuehl et al.
2011/0147417 A1 6/2011 Kuehl
2011/0148216 A1 6/2011 McCoy
2011/0148223 A1 6/2011 McCoy
2011/0148649 A1 6/2011 de Cavalcanti et al.
2011/0148650 A1 6/2011 Jenkins et al.
2011/0148651 A1 6/2011 Hendrickson et al.
2011/0149485 A1 6/2011 Kuehl et al.
2011/0152024 A1 6/2011 Kuehl
2011/0153739 A1 6/2011 McCoy
2011/0153821 A1 6/2011 McCoy
2011/0153871 A1 6/2011 Ferragut, II et al.
2011/0153880 A1 6/2011 McCoy

FOREIGN PATENT DOCUMENTS

JP 06310202 A 11/1994
JP 06310204 A 11/1994
JP 06333633 A 12/1994
WO 2007/015274 A1 2/2007
WO 2007080584 A 3/2007

* cited by examiner

SUBSTANCE COMMUNICATING DEVICE WITH MECHANICALLY ENERGIZED CONNECTOR SYSTEM

BACKGROUND

Appliances and other useful household equipment are increasingly designed to interact with one another, as well as with a variety of consumer accessory devices. A consumer accessory device may be used, for example, in conjunction with an appliance to enhance or supplement the functionality of the appliance.

BRIEF SUMMARY

The present disclosure relates to substance communicating devices and coupling systems for substance communicating devices.

According to one aspect of the invention, a substance communicating device is used in conjunction with an appliance having a first substance connector component and a first switch component. The substance communicating device comprises a main body, a substance consumer associated with the main body, a substance line having a first end coupled with the substance consumer and a second end remote from the first end, a second substance connector component operably coupled with the second end of the substance line, the second substance connector component being operably actuatable by the first substance connector component to permit the communication of a substance between the first and second substance connector components, and a second switch component being configured to actuate the first switch component when the first substance connector component is adjacent with the second substance connector component to selectively draw the first and second substance connector components into engagement and to selectively permit the communication of the substance between the substance communicating device and the appliance.

According to another aspect of the invention, a system comprises an appliance having a first service connector component, a substance communicating device having a second service connector component operably engageable with a first service connector component, a service switch operably associated with one of the first and second service connector components, the switch being configured to selectively permit the communication of a service between the substance communicating device and the appliance, and an actuator associated with the other of the first and second service connector components, the actuator being configured to selectively actuate the service switch when the first service connector component is adjacent the second service connector component to selectively draw the first and second service connector components into engagement to permit the communication of the service between the substance communicating device and the appliance.

According to yet another aspect of the invention, an accessory is used in conjunction with an appliance having a first electromagnetic connector component, a first switch component, and a first substance connector component. The accessory comprises a main body having a substance consumer, a second electromagnetic connector component operably engageable with the first electromagnetic connector component to permit the communication of an electromagnetic service between the first and second electromagnetic connector components, a second switch component configured to actuate the first switch component when the first electromagnetic connector component is adjacent the second electromagnetic connector component to permit the communication of the electromagnetic service between the accessory and the appliance, and a second substance connector component operably coupled with the substance consumer, the second substance connector component being operably actuatable by the communication of electromagnetic service between the first and second electromagnetic connector components to permit the communication of a substance between the first and second substance connector components.

DETAILED DESCRIPTION

Figure 1:
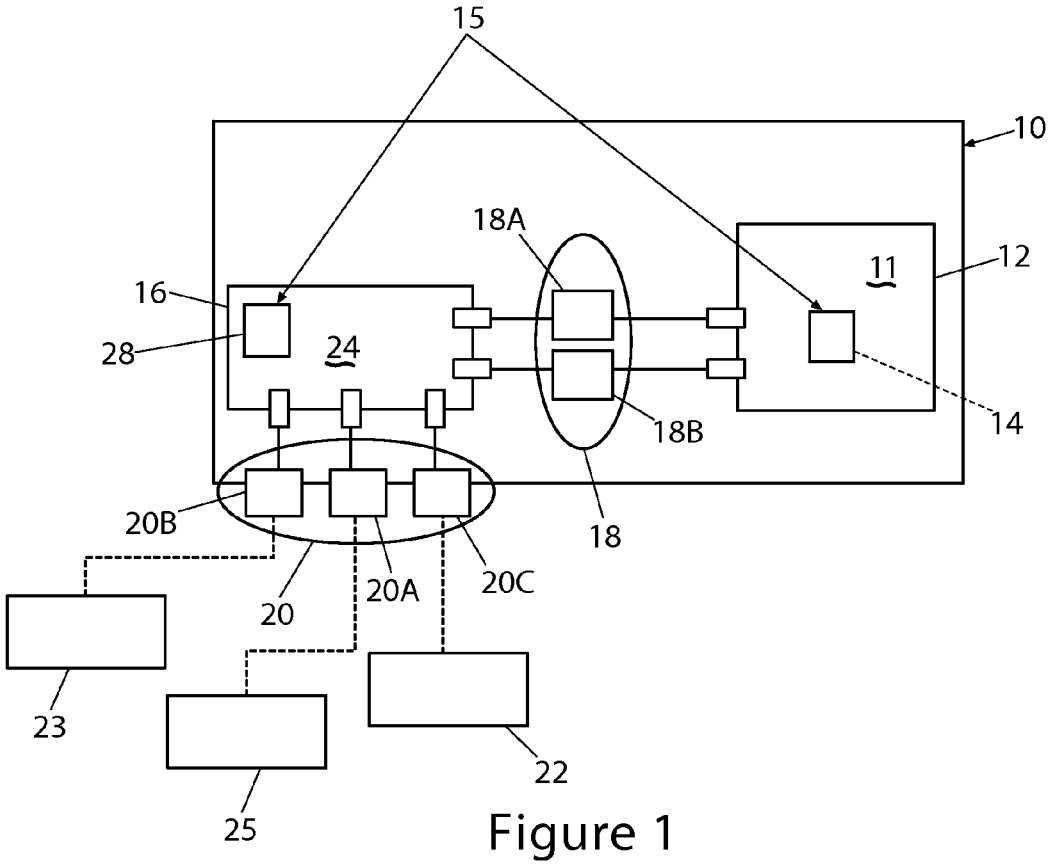
FIG. 1 is a schematic view of an appliance coupled to, and comprising, a consumable holder.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or to otherwise limit or restrict the claims to the precise forms and configurations shown in the drawings and disclosed in the following detailed description.

The drawings and the following detailed description relate generally to substance communicating devices and coupling systems for connecting substance communicating devices. The following definitions apply to terms that may be used in the specification and the claims, unless otherwise noted.

As used herein, a "substance" is a material that may be communicated from one device to another. A substance may include a gas, a liquid, or a solid, or any combination thereof. Examples of substances include, but are not limited to, liquid soap, powdered soap, compressed air, tablets, caplets, water, ice cubes, and a beverage.

As used herein, "substance communication" or a "substance communication service" is a useful provision of a substance from one device to another device. Communicating a substance includes supplying or receiving a substance. As used herein, communication of substance includes both uni-directional and multi-directional communication between any two devices, either directly or through an adapter, as defined herein. Substance communication may be provided in quanta, such as capsules or other doses of substances, batches of discrete items, such as tablets, or consumable components.

The term "consumable" and any variation thereof, as used herein, includes any substance that may be consumed by a host, an accessory device, or a user person, such as food, cosmetics, or medicine. The consumable may, for example, be a substance that is used up and must be replenished for subsequent cycles of operation. For a clothes washer, a consumable might be a detergent and/or a softener. For a clothes dryer, a consumable might be an anti-static cloth. For a cooking or refrigeration appliance, the consumable may actually be the article on which the appliance performs its cycle of operation, as in the case of food, later to be consumed by a person. More specific examples of the use of a consumable in appliances include dispensing additives for clothes washers, clothes dryers, or combination washer/dryer appliances. The additives may include, but are not limited to, normal detergents, gentle detergents, dark clothing detergents, cold water detergents, fabric softeners, chlorine bleaches, color-safe bleaches, and fabric enhancement chemistry. Non-limiting examples of fabric enhancers are additives to provide stain resistance, wrinkle resistance, water repellency, insect repellency, color fastness, fragrances, and anti-microbials. Another example of a consumable are the filters used by an appliance. Refrigerators, dryers, washers, and dishwashers are all known to use filters that are consumed in the sense that they wear out and must be replaced.

The term "substance consumer" and any variation thereof, as used herein, is any useful device that employs, uses, stores, or dispenses a substance in connection with performing a physical or virtual function. A substance consumer may be, for example, a smart utensil, an appliance, a resource controller, such as a water controller, a dispenser, a filter, a water filter, an air filter, a detergent dispenser, a drink dispenser, a detergent cartridge, or a substance holder, such as a bottle, or a jug, or a cycle accessory.

The term "substance provider" and any variation thereof, as used herein, is any device that is capable of providing or supplying a substance to another device.

As used herein, the term "substance holder" is anything that holds or contains a substance, which may include, but is not limited to, a container, a dispenser, a cartridge, a dish, a bag, or a carton.

As used herein, the term "consumable holder" is any substance holder that holds or contains a consumable.

As used herein, the terms "substance communication coupling system" or "substance service connector system" refer to any connector system having at least two separate substance communication coupling system components, each of which is associated with a useful device. The substance communication coupling system components cooperate with one another to couple the useful devices to facilitate communication of a substance between the useful devices.

As used herein, the term "substance switch" is any component used to selectively facilitate the communication of a substance between components of a substance coupling system, such as by drawing the components into engagement or by permitting the flow of a substance from one of the components for transfer to the other of the components.

As used herein, the term "switching valve" is any valve used to selectively facilitate the communication of a substance between components of a substance communication coupling system.

As used herein, the terms "substance line" or "substance pathway" refer to a pathway for transferring a substance from one location to another. The substance line may have any of a variety of configurations depending on the type of substance being transferred, including, but not limited to, a pipe, a conduit, a tube, a channel, or fluidically-aligned supply and receiver ports with a gap therebetween.

As used herein, an "electromagnetic service" is electrical power or data. An electromagnetic service may comprise multiple categories of electromagnetic service, such as electrical power and data in a single signal. An electromagnetic service may be provided continuously or for specified times or for specified amounts or for the duration of certain events, such as the duration of coupling to provide timed dispensing. Alternatively, an electromagnetic service may be provided in quanta, such, as packets of data. Also alternatively, an electromagnetic service may include data encoded into in waves such as light, radio, and sound.

"Wireless" refers to a type of communication in which power and/or data is transferred over a distance without the use of electrical conductors or wires. For example, electromagnetic waves, light waves, or acoustic waves can be used to carry power and/or data over a distance without using electrical conductors or wires.

"Electrical power communication" is the coupling of at least two devices to supply electrical power from at least one of the devices to the other of the devices, such as through directly connected electronic lines or through wireless power communication (also referred to as wireless power transmission). Wireless power communication may include any type of wireless power communication, including, without limitation for illustration purposes, microwave transmission, laser transmission, and magnetic fields. Exemplary categories of power communication include the type of power, e.g. alternating current (also known as AC) or direct current (also known as DC), supplied to the functional device and variations in the characteristics of the power, such as the voltage or current.

"Data communication" is the coupling of at least two devices to transmit data from at least one of the devices to the other of the devices, such as through directly connected electronic lines or through wireless data communication (also referred to as wireless data transmission). The data may be transmitted as a separate signal or embedded in electrical power communication. Wireless data communication may include any type of wireless data communication, including, without limitation for illustration purposes, wireless network technology (a/k/a Wi-Fi), radio transmission, light transmission, and acoustical transmission. Exemplary categories of data communication include encrypted and unencrypted data. Data communication also includes communication for different protocols, including physical layer protocols and software layer protocols. Examples of physical layer protocols are a wired Ethernet and a wireless (using Wi-Fi) network, both of which may support the same data packet structure. Examples of software layer protocol are Zigbee® and Bluetooth®. Data communication may also be completed by way of an analog mechanical transmission means such as by means of fluidic pulses created by positive pressure systems or vacuum systems or by a mechanical logic transfer means, such as the throwing of switches or levers to actuate or transmit information about a control state.

"Communicating" as used herein with respect to an electromagnetic service means supplying or receiving an electromagnetic service. As used herein, communication of electromagnetic service includes both uni-directional and multi-directional communication between any two devices, either directly or through an adapter, as defined herein.

A "substance communicating device" is any substance holder, substance provider or substance consumer that is capable of communicating substance with another device. Examples of a substance communicating device include a dispenser, a filter, a water filter, an air filter, a detergent dispenser, a drink dispenser, a detergent cartridge, a bottle, a jug, a flavoring dispenser, a steam dispenser, a fragrance dispenser, a food ingredient dispenser, a cycle accessory, and a chemistry dispenser.

A "substance communicating system" is any combination of substance communicating devices capable of communicating a substance therebetween.

A "service connector system" is a connector system having at least two separate service connector components, also referred to as service couplers, each associated with a useful device. The service connector components cooperate with one another to couple the useful devices to facilitate communication of a service between the useful devices. A service connector system may carry multiple services. An electromagnetic service connector system, for example, may be associated with or incorporated into a substance connector system or may be independent of a substance connector system but be associated with the same substance holder, substance provider or substance consumer.

A "switched service connector system" is a service connector system having a switching capability in at least one of the service connector components operable to selectively permit the communication of a service between the components of the service connector system.

A "service switch" is any component used to selectively permit the communication of a service between components of a service connector system. A service switch which selectively permits the communication of a substance may be referred to as a "substance switch". A service switch may be associated with more than one type of service. For example, an electromagnetic service switch may be associated with, integrated with, or comprise a substance switch or may be independent of a substance switch.

A "switch component" is any component in an assembly of components that cooperate to selectively operate a service switch, including, but not limited to, linkages, actuators, mechanical switches, and any sub-component thereof.

A "service line" is a pathway for transferring a service from one location to another. The service line may have any of a variety of configurations, including but not limited to a pipe, conduit, wire, tube, channel, and fiber optic cable, to name a few. More particularly, to transfer electrical power or data service communication, an electromagnetic service line may include an electrically conductive wire, an optical data cable, or a wireless transmission system.

The terms "provide" and "supply" and any variation thereof, are used herein to denote a source of the substance or an electromagnetic service relative to a device receiving the substance or electromagnetic service. Neither term is limited to the original source of the substance or electromagnetic service. A device that provides or supplies the substance or electromagnetic service may simply be passing on the substance or electromagnetic service from the original source. For example, a device that provides water may pass on water it receives from a residential water supply. However, the device may alternatively or additionally provide another substance that originates with the device, such as an additive stored in a reservoir.

The term "receive" and any variation thereof, is used herein to denote receipt of a substance or an electromagnetic service relative to the device providing the substance or electromagnetic service. The term is not limited to the ultimate consumer of the substance or electromagnetic service. The term "receive" is applicable as well to a device that may simply be passing on the substance or electromagnetic service from the source, such as an appliance, to a device that will consume, as hereinafter defined, the substance or electromagnetic service. The device which receives a substance or an electromagnetic service is not necessarily the end consumer of the substance or electromagnetic service.

The term "consume" and any variation thereof, as used herein, denotes the act of employing or dispensing at least a portion of the substance or electromagnetic service received in connection with performing a function.

The term "coupled" and any variation thereof, as used herein, includes any type of connection that permits transfer of a substance or an electromagnetic service between two devices. The term "coupled" does not require a physical connection between the two devices, so long as the coupling permits transfer of a substance or an electromagnetic service. The term "coupled" includes both fixed and removable coupling, as well as both continuous and intermittent coupling.

The term "useful device" and any variation thereof, as used herein, is a device that is capable of performing a useful physical or virtual function either alone or in combination with another device.

As used herein, the term "host" is an apparatus that has a primary function independent of providing or receiving a substance. A host may be a substance provider, a substance consumer, or both. For example, the host may be an appliance and the primary function may be performing a series of steps to conduct a useful cycle of operation. The appliance may be a conventional household appliance, such as a refrigerator performing a cooling cycle or an ice making cycle. Other examples of appliances that may be hosts include, but are not limited to, a freezer, a conventional oven, a microwave oven, a dishwashing machine, a stove, a range, an air conditioner, a dehumidifier, a clothes washing machine, a clothes dryer, a clothes refreshing machine, and a non-aqueous washing apparatus, or any combination thereof. Alternatively, the host may be a fixture such as a water softener, a water heater, a furnace, pool water treatment equipment, or an HVAC system. The host may be a small device such as a thermostat, a blender, a mixer, a toaster, a coffee maker, a trash compactor, an air purifier, an iron, a vacuum cleaner, or a robot. The host may alternatively comprise a structural feature of a building, such as a wall, a cabinet, or a door. The host may also provide other services, such as electrical power, electronic data, mechanical power, illumination, heat, or sound.

As used herein, the terms "accessory" or an "accessory device" refer to any useful device which may be coupled to a host and communicate a substance to or from the host. An accessory device may be used primarily in conjunction with a host to enhance, supplement, regulate, or monitor the functionality of the host or may have independent functionality and utility. An accessory device may be a substance provider, a substance consumer, or both. An accessory device may be a substance holder or a consumable holder. Examples of an accessory device include, but are not limited to, a paper product dispenser, a dry goods dispenser, a bottle opener, a liquid dispenser, a pill dispenser, a water dispenser, a fan, a motor, a tissue dispenser, a can opener, a mixer, a blender, an ice dispenser, an ice maker, an ice cream maker, a coffee maker, a soap dispenser, and a softener dispenser. An accessory or accessory device may also communicate electromagnetic service with the host.

A "proximity target" as used herein is any component or device that may be detected when positioned within a predetermined distance of an associated proximity sensor, defined below. A proximity target may be passive, such as a visual target or a magnetic target formed of magnetic or magnetic responsive material. Other examples of passive proximity targets may include a conductive component or surface capable of cooperating with a magnetic field, a current, or a voltage provided by a proximity sensor. A proximity target may alternatively be active or powered such as an electromagnet, a generator of a magnetic field, a current, a voltage or an acoustic wave. An active proximity target may alternatively provide a powered readable display or dispense a detectable chemical.

A "proximity sensor" as used herein, is any component or device that may detect an associated proximity target when the proximity target is within a predetermined distance of the proximity sensor. A proximity sensor may detect, for example, a change in an electromagnetic field, an electromagnetic wave, an acoustic wave, a visual target, a chemical component, an electrical signal, a change in voltage, a change in current, a change in frequency, a change in resistance, a change in inductance, a change in capacitance, a mechanical signal, a change in pressure, a displacement, a vibration, and the presence of a chemical. A proximity sensor may be active or passive, such as a magnetic sensor of magnetic or magnet responsive material, or may alternatively be active. Examples of active sensors include active magnetic sensors, light sensors, optical sensors, acoustic sensors, electromagnetic sensors, chemical sensors and thermal sensors. Examples of magnetic sensors include magnets and magnetic responsive components. Examples of optical sensors include infrared sensors, photoelectric sensors, fiber optic sensors, photo resistors, photovoltaic sensors, photo diodes and cameras. Examples of electromagnetic sensors include radio receivers, radar sensors, Hall Effect sensors, inductive sensors, capacitive sensors, variable reluctance sensors and eddy current sensors. Examples of acoustic sensors include ultrasonic sensors and microphones. A contact proximity sensor detects a proximity target by touching the proximity target. A contactless proximity sensor detects the proximity target through a wireless or contactless means. For example, magnetic flux can be used as the signaling mechanism between a contactless proximity sensor and a contactless proximity target.

As used herein, the term "proximity system" is a system that uses a "proximity switch" operated by a plurality of "proximity coupling components," each associated with a different parent device, for determining that the parent devices are in proximity with each other. Parent devices are usually paired, examples of which include a service provider and a service consumer, a host and an accessory device, and a host and an adapter. Proximity coupling components may include a proximity target associated with one parent device to actively or passively provide an indication of the presence of the one parent device and a proximity sensor associated with the other parent device that is responsive to the presence of the proximity target to activate the proximity switch. The proximity switch may be used to provide a signal or message indicative of the proximity of the parent devices or may directly or indirectly regulate the flow of a service along a service line. The proximity systems disclosed herein employ contact proximity systems, wherein the proximity target and proximity switch use physical contact to detect the proximity of the two parent devices.

A "plug" as used herein is a generally male electromagnetic service connection component.

A "receptacle" as used herein is a generally female electromagnetic service connection component.

An "adapter" as used herein is an intermediate device that may be provided between a first and second useful device, such as between a host and an accessory, to facilitate the communication of services between the first and second useful devices. An adapter may receive a service from the first useful device and provide a modified version of the service to the second useful device, for example, by providing an electrical power service using a different voltage or providing a data service using a different data structure or signal type. In some applications, multiple adapters may be interposed between two accessory devices. In other applications, three or more devices may be coupled to a single adapter, such as between a host and two accessories. In some applications, the adapter may itself be an accessory device providing a useful function not provided by the accessory devices coupled to it. An adapter may optionally include a transformative component that transforms a service from a service provider to a different service, which is supplied to a service consumer. This may be useful when the service from the service provider is not compatible with the service consumer. The transformative component can be configured to transform the service into a compatible form for the service consumer. Examples of transformative components are protocol converters, power transformers, or other devices that convert substance, energy, or data from a first form to a second form.

Figure 2:
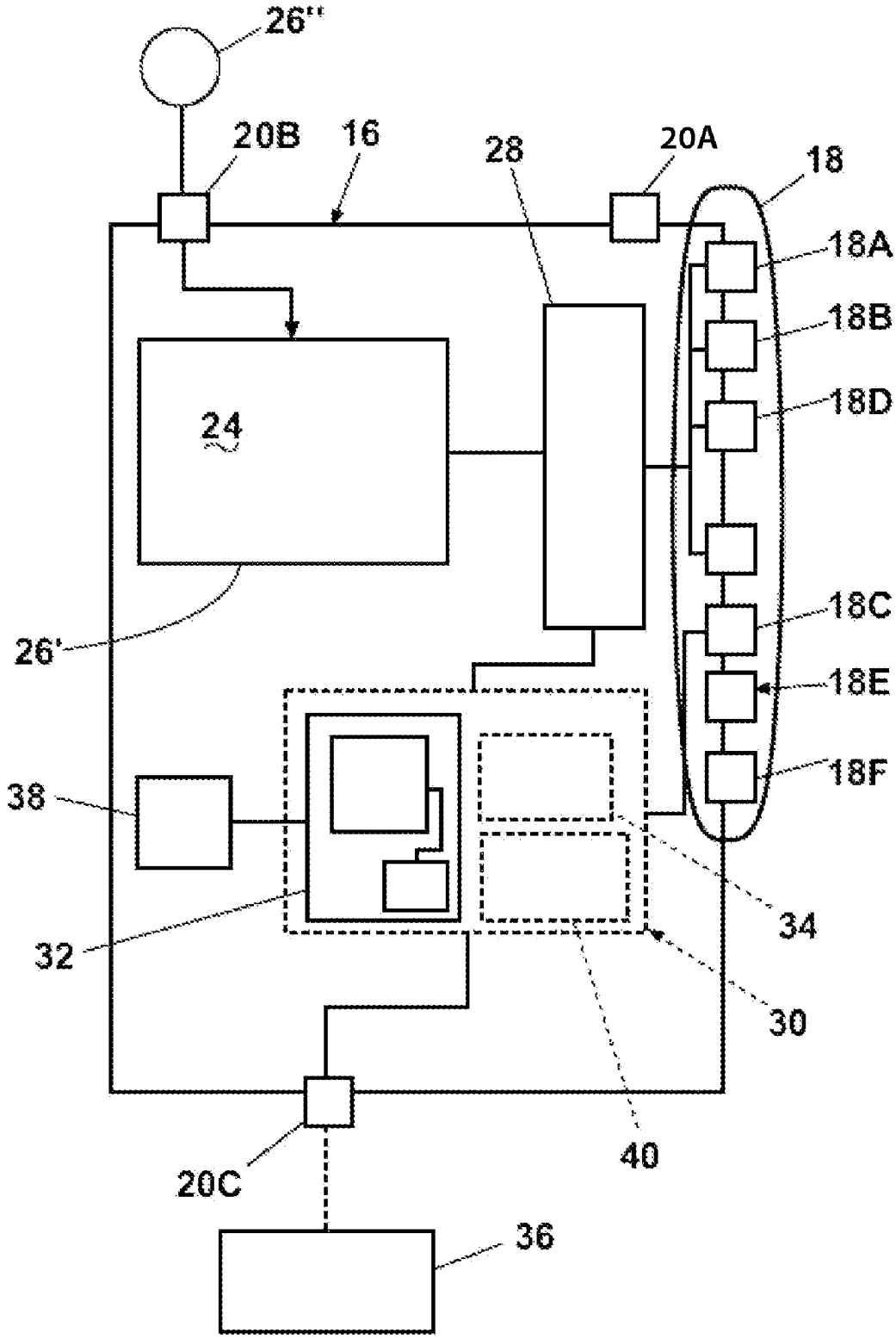
FIG. 2 is a schematic view of the consumable holder of FIG. 1.

Referring to FIG. 1, a substance communication system 10 is illustrated in schematic form and has a first substance communicating device 12, such as an appliance, with a smart process control apparatus 14, and a second substance communicating device 16, such as a consumable holder. Second substance communicating device 16 may be disposed inside, outside, or on the first substance communicating device 12. It may be installed during manufacture and sold with first substance communicating device 12, or it may be made and sold separately as an upgrade or addition. Second substance communicating device 16 may optionally have its own process control apparatus 28, which may be in communication with smart process control apparatus 14 of first substance communicating device 12 or may operate independently. Process control apparatus 14 and 28 may provide at least a portion of the system software architecture and electronics 15 for substance communication system 10. Process control apparatus 14 and 28 may include sensors, actuators, wiring, and other components normally found in an electro-mechanical or mechanical control system. Either process control apparatus 14 or 28 may be able to control itself in limited ways through mechanical techniques. More typically, and as illustrated herein, electronics 30, shown in FIG. 2, are connected to the process control apparatus 28 providing additional functionality. Process control apparatus 28 and electronics 30 may be considered in combination as a smart process control apparatus. Smart process control apparatus 14 may also includes electronics which interact with the process control apparatus 14 in order to make control decisions based on inputs from sensors or networks and execute those decisions either by network message or the control of actuators within the process control apparatus, but the electronics are not illustrated herein.

First substance communicating device 12 may communicate, through an interface or service connector system 18, a substance with second substance communicating device 16, and may as well communicate one or more additional services, such as a data service or a power service. Service connector system 18 may include one or more service couplers or connector components, such as 18A and 18B, for enabling the communication of one or more services, such as, for example, multiple substance services or a substance service and an electromagnetic service. For example, first substance communicating device 12 may be an automatic clothes washer acting as a host for the second substance communicating device 16, and second substance communicating device 16 may be an additive dispensing accessory capable of dispensing one or more fabric treatment chemicals, such as detergent, bleach or softener, for use by the automatic clothes washer in the processing of a fabric load. As another example, first substance communicating device 12 may be a refrigeration appliance having a water supply and acting as a host for the second substance communicating device 16, and second substance communicating device 16 may be a flavoring dispensing accessory capable of dispensing one or more food flavoring chemicals, such as fruit flavored drink powder, for use by the refrigeration in providing consumers with a flavored drink. As another example, first substance communicating device 12 may be a refrigeration appliance having a water supply and acting as a host for the second substance communicating device 16, and second substance communicating device 16 may be a drink dispensing accessory holding one or more food flavoring chemicals, such as fruit flavored drink powder, and capable of receiving cooled water from the refrigeration appliance, mixing it with a food flavoring chemical, and dispensing a drink to a consumer. These and other examples are discussed below in more detail.

In general, first substance communicating device 12 may be configured to perform an operation on a physical article 11, such as clothing or food, using a resource such as water, temperature-controlled air (hot or cold), steam, gas, or electricity, provided to first substance communicating device 12 by interfaces, not shown, with a utility, not shown, supplying the resource. Examples of appliances that perform an operation on a physical article include a wide range of device types, including but not limited to, washers, dryers, ovens, ranges, steam cookers, ice makers, refrigerators, drink makers and the like. Articles 11 are the objects upon which a user intends the appliance to perform its cycle of operation. Typical examples as mentioned above would include food and clothing.

Smart process control apparatus 14 is configured to implement and control a cycle comprising at least one operation. Smart process control apparatus 14 may comprise one or more components, not shown, such as electronic control boards, wiring and wiring harnesses, power-supplies, sensors integrated with the electronics as digital or analog inputs, and actuators like valves, relays, heaters, and the like, any or all of which may integrate with the electronics as digital or analog outputs.

Second substance communicating device 16 is configured to hold, carry, supply, communicate with, or otherwise interact directly with a consumable 24. When performing a cycle of operation on an article 11, first substance communicating device 12 will often use at least one consumable 24. A consumable 24 in one sense comprises a substance, device, or other product that would be at least partially consumed or transformed by first substance communicating device 12 during a cycle of operation on an article 11, such that consumable 24 may be periodically replaced or replenished. The period after which consumable 24 may be replaced or replenished may be, but is not limited to, a single cycle of operation, multiple cycles of operation, an amount of time, or a number of uses. For example, many common washing machines require that a user place a single dose of detergent in a dispenser prior to initiating a cycle of operation. For each subsequent cycle of operation, the user must again place a single dose in the dispenser, as a single dose of detergent is consumed by the washing machine during each cycle of operation.

In some cases, the consumable 24 may be the article 11, on which the first substance communicating device 12 performs the cycle of operation, and the consumable may be subsequently consumed by a user. A consumable 24 may, for example, be anything that would be consumed or otherwise used by a person, such as food, beverages, cosmetics, or medicine. For example, in a cooking or refrigeration appliance, the consumable may be a food item communicated from a dispenser to an appliance, and the cycle of operation performed by the appliance may be heating or cooling the food.

Consumables are to be distinguished from resources, although resources may in some circumstances be "consumed" during a cycle of operation. Resources are commodities that are continuously available to an appliance, and used by the appliance in its cycles of operation on articles 11 that are supplied by external utilities, such as a residential water, power, data or natural gas distribution system, or are available from the ambient environment, such as air. In some cases, a material resource, such as air and water, may also be considered an article 11 as in a refrigerator that chills and dispenses water. That is, water in that instance is a resource (continuously available to the refrigerator from a residential utility), but also an article 11 (intended by the user for the refrigerator to act upon). The cycles of operation performed by the refrigerator would include the chilling and dispensing. Things that hold or supply resources, such as water supply lines or air conduits are not considered consumable holders 16. They would be "resource holders", which may be supplied by resource providers. In a refrigerator, for example, water supplied to the first substance communicating device 12 would be considered a resource and/or an article 11. If flavoring is mixed with the water supplied to first substance communicating device 12, the flavoring may be considered a consumable 24, and whatever holds/supplies the flavoring is then considered to be second substance communicating device 16.

Consumables are also to be distinguished from parts in an appliance, although parts wear out and need to be replaced or replenished as do consumables. Parts are devices, without which a cycle of operation by the appliance or a principal function of the appliance would be hampered. Examples include valves, actuators, switches, tubes, lamps, wiring, motors, pumps, seals, gears and the like. Consumables, on the other hand, are typically not critical to the operation of the appliance, although they provide a benefit to a user of the appliance. An appliance may typically still operate on an article 11 in some fashion without a consumable, though not necessarily as effectively or efficiently.

Second substance communicating device 16 comprises a device that holds or contains consumable 24. Typically, consumable 24 is contained by a consumable holder. In some cases, second substance communicating device 16 may be nested within one or more other consumable holders. For example, a cartridge holding a consumable may be disposed in a dispenser.

In some cases articles 11 on which the appliance operates may not be contained by a consumable holder, and may not be consumables in the sense herein defined. Rather, the articles 11 may be enabled to perform at least some of the functionalities of a consumable and/or a substance communicating device. An example of an article 11 with substance communicating device capabilities is a shirt having a bar code thereon containing information that is directly readable by first substance communicating device 12. The bar code may be, for example, on a performance tag. First substance communicating device 12 may use data and/or information represented by the bar code for use in configuring and selecting the cycle of operation of the appliance. The bar code may be read by first substance communicating device 12 while the shirt is being operated contemporaneously with the cycle of operation.

A performance tag is an information holder either integrally formed or selectively attached to an article 11 and adapted to maintain its integrity over the life of the article 11. For example, a performance tag for clothing would be adapted to maintain its integrity throughout the repeated processes of washing in a washing machine appliance, drying in a dryer, being cleaned at a dry cleaners, being ironed, being left in the sun, and being subjected to the impacts sustained during usage. Examples of impacts sustained during usage for a shirt are those that might occur during a soccer match where the shirt impacts the earth and other players at considerable speeds and forces repeatedly. Likewise, performance tags for dishes would be subjected to similar impacts, and similar wash and dry cycles from a dishwasher. Performance tags integrally formed with fabric items might be sewn in, glued in, woven in, stamped on, or printed on during the manufacturing of the article 11 or by a home machine adapted to integrate the article 11 and the tag. Performance tags integrally formed with dishware might be glued, stamped, printed, embossed, cast, molded, or otherwise formed during the manufacturing of the article 11 or by a home machine adapted to integrate the article 11 and the tag. Performance tags that are selectively attached to an article 11 could be attached by sewing, gluing, pining, sticking, printing, embossing, or other like methods in the home environment for articles 11 not specifically adapted for receiving a performance tag. Performance tags are constructed of any suitable material, which that may be used to hold encoded information about a cycle structure, or information about a consumable, the description of which is contained herein. Examples of materials for holding the information include magnetic strips, bar codes, and images of encoded data including color patterns, shape patterns, plain texts, numeric identifiers, and the like. An appliance having a cycle architecture and being in communication with a performance tag (as for example by using a consumable reader) may optimize the cycle of operation in the appliance for the article 11 in response to the cycle structure, data about a cycle structure, and/or data about a consumable held by the performance tag. Performance tags may either hold information or hold other information about how to find the information. An example of a performance tag that holds other information is a performance tag holding a URL wherein the data returned when invoking the URL is the information. Further, the appliance may alter or optimize the user experience by providing information on a user interface in response to the cycle structure, data about a cycle structure, and/or data about a consumable.

Other examples further illustrate the foregoing distinctions. Consider using an oven to cook a turkey in a roasting pan where there is a steam dispenser with a basting cartridge for automatic basting. The turkey is the article 11 upon which the appliance (the oven) performs its cycle of operation (cooking). However, the turkey is also a consumable in the sense that it is a food item to be consumed by the user. The basting cartridge would be a consumable holder and its contents a consumable. The water used to generate the steam is a resource, making the steam a changed resource. The roasting pan would be a second consumable holder, holding the turkey. The appliance or the roasting pan, or some other device (such as a performance tag described below) may also hold information about the turkey or how to cook a turkey or how to cook a turkey in different kinds of ovens. Such information would be considered information about a consumable and information about a cycle structure.

Consider also a powdered detergent box with a performance tag configured to communicate with an appliance contemporaneously with the dispensing of the detergent to a washer. The washer is the appliance, the detergent is a consumable, and the box is a consumable holder. The performance tag may hold information about the chemistry of the powder, information about cycle structures, and data about cycle structures wherein the information and data are associated with other information comprising appliance types, fabric types, stain types, and the like so that the data and information may be used alone or combined with the other information to create a cycle of operation in response to the data and the information and in response to the user and the user preferences about the cycle of operation, the data, the information, and the other information.

Consider also a detergent pellet with an etched or embossed, or imprinted cycle structure enabled to communicate with an appliance contemporaneously with being introduced into a washing machine before or during a wash cycle. Here, the washing machine is an appliance and the detergent pellet is a consumable. There is no separate consumable holder. The cycle structure is intended to effect the cycle of operation (washing). Consider also a detergent pellet having a data pod. The detergent pellet is a consumable, but the data pod is a form of performance tag that could communicate with an appliance contemporaneously with being introduced into the use environment for the purpose of effecting the cycle of operation.

A consumable or a consumable holder or a performance tag or data pod, or anything that may hold and convey information (consumable information holder) might comprise one or more cycle structures. A first cycle structure may be associated with a first appliance or first appliance type and a second cycle structure may be associated with a second appliance or a second appliance type such that the appropriate cycle structures are introduced to the appropriate appliance or appliance type when the consumable or consumable holder is in useful communication with the appliances. For example, a frozen food (a consumable) or a package of frozen food (a consumable holder) might have cycle instructions for freezing, defrosting, or preserving cycles in a refrigerator or freezer appliance, and also might have cycle instructions for defrosting, cooking, or warming cycles for a cooking appliance like an oven or microwave.

A consumable information holder may comprise one or more user interface data sets, with or without cycle structures, which may be communicated to a user interface, such as might be on the appliance. User interface data is considered to include anything that may be rendered to be responsive to a user's senses, such a visual displays, audible sounds, and tactile displays. A first user interface data set may be associated with a first appliance or first appliance type and a second user interface data set may be associated with a second appliance or a second appliance type such that the appropriate user interface data are conveyed to a user interface associated with the appropriate appliance or appliance type when the consumable or consumable holder is in useful communication with the appliances. For example, a frozen food (a consumable) or a package of frozen food (a consumable holder) might convey to a refrigerator an expiration date to be rendered on a user interface on the refrigerator. The frozen food or its package might also convey to an oven serving suggestions to be rendered on a user interface on the oven.

Consumables, consumable holders, performance tags, data pods and the like (consumable information holders) may be enabled not only to provide data, but also may be configured to receive and store information associated with the consumable. Exemplary information includes data about a consumable, a cycle structure, data about a cycle structure, tracking the number of times a shirt or a dish is washed, the number of cycles and the parameters thereof, which have been executed by or in combination with an appliance and consumable holder. It may also include the types of consumables introduced into the use environment, information entered into an appliance user interface including cycle selections, usage patterns, user information, user identification, other data associated with the cycle of operation of an appliance, and any data held by a data source in communication with the holder, tag, or pod which either the data source writes to the holder, tag, or pod, or any data or the holder, tag, and pod reads from the data source. Such information may be sequentially added to a database on the consumable information holder for later retrieval. For example, a shirt with a performance tag may keep data about how many times it has been washed, about different wash cycles it has been through, and the specific machines in which it has been washed.

More specific examples of consumables 24 for use with or by appliances such as first substance communicating device 12 include dispensing additives for laundry washers, dryers, or combination washer/dryer appliances. Other additive examples are provided in the definition of consumables above.

An additive dispenser in this case would be second substance communicating device 16 and may be a single load dispenser that dispenses all of additive contained therein during a single cycle or a bulk dispenser that dispenses only some of the additive contained therein during a single cycle. An appliance comprising a bulk dispenser may meter and dispense the correct amount of additive for each particular load and provide information to the user regarding the remaining amount of additive in the bulk dispenser after dispensing.

Because each additive may have different parameters associated with its use, information about each consumable may be provided with each consumable 24. This information may be provided on the packaging of consumable 24 (i.e. the consumable holder), in consumable 24, or by any other suitable means (performance tag, data pod, user interface, etc.). For example, different additives may have different concentrations, and the amount of a given additive needed for a particular load will vary depending on the concentration of that additive. The amount of a particular additive needed to complete a cycle of operation will also depend on the amount and type of laundry being treated, as well as the condition of the laundry (e.g. soil and stain level). The amount, type, and condition of the laundry may be determined utilizing information supplied by the user, information gathered by sensors associated with the appliance, or information otherwise obtained during the operation of the first substance communicating device 12.

Additional information provided with the consumable may also be used to tailor the cycle of operation to that consumable 24. In a laundry application, the additive will have to be dispensed at the right time during the cycle, such as before, during, or after wash, rinse, spin, or drying. Particular additives may also require that they are dispensed under certain conditions, such as at a given water temperature or air temperature. Additionally, particular additives might require at least one additional step in a cycle for optimal performance. For example, the presence of a particular additive might require that the cycle structure be augmented by inserting an additional ordered collection of steps such as filling at a new temperatures to a new level after spinning, then soaking for an amount of time, then draining, then spinning for a new amount of time at a new spin speed between the original step in the cycle and the last step in the cycle.

The smart process control apparatus 14 or electronics 30 may determine parameters to be used for the cycle of operation or the structure of the appropriate cycle of operation or changes to an existing cycle of operation for different operations based on the information provided with consumable 24, user input, and information obtained by sensors associated with first substance communicating device 12. Exemplary types and sources of information are found in the following table:

| Information provided from the consumable or consumable holder | Information provided by the user | Information provided by appliance sensors |
|---|---|---|
| New order collection of cycle steps, actions for each step, a plurality of transition logic expressions for each step, and the relationships between steps, actions, and logic expressions | Fabric type | Soil level |
| Additive type | Desired cycle | Load weight |
| When in cycle to dispense | Fabric type | Load absorption |
| Any special cycle parameters | Load size | Additive remaining in dispenser |
| Amount to dispense for a standard load | Fabric condition (soil level, stains, etc.) | Soil level |
| Special dispenser maintenance considerations | Dispensing compartment used | None |

Another example of a consumable includes filters used by first substance communicating device 12. Refrigerators, dryers, washers, and dishwashers are all known to use filters that are consumed in the sense that they must be replaced after a certain amount of time or usage due to wear and dirtying of the filter. Filters, in particular, depending on the embodiment may be construed as a consumable, a consumable holder, or both. For example, if there is a filter assembly holding a filtering material, then the filter assembly may be considered a consumable holder and the filtering material may be considered a consumable because it is disposed of after its usability is consumed; its life and the life of the consumable holder are significantly different. On the other hand, the filter assembly and the filter material may be integrally formed and introduced and removed from the use environment as a unit. In this case, the assembly and the filter material would be considered both a consumable holder and consumable because the assembly and the filter material comprise functionality and attributes of both consumable holders and consumables.

Consumables may also include food, as mentioned above, and articles of clothing. Such consumables may or may not be contained by a consumable holder. However, non-contained consumables may still have consumable holder functionality in that they may comprise information about the consumable that is retrievable by the appliance. For example, a food item may carry information about itself that is contained in edible ink printed on the surface of the food item.

Returning to the drawings, service connector system 18 may be an internal or external interface configured to couple second substance communicating device 16 and first substance communicating device 12. Substance communication system 10 may also be provided with an interface or service connector system 20 for removably connecting one or more additional accessory devices, described below. Interface 20 couples accessory devices 22, 23, or 25 to second substance communicating device 16, but it will be appreciated that such an interface may alternatively or additionally be provided on first substance communicating device 12.

Interface 20 may include one or more service couplers or connector components, such as 20A, 20B, and 20C for enabling the communication of a one or more services such as substance service, power service, or data service provided by any other source or device, such as devices 22, 23 and 25, that may be advantageously used with the first substance communicating device 12 and/or second substance communicating device 16. One or more of the accessory devices 22, 23 and 25 may have a process control apparatus, not shown, that may interact with or become a part of system architecture and electronics 15 when coupled with substance communication system 10.

Accessory device 22 may, for example, comprise a power source, a consumable source, a consumable dispenser, a consumable reader, a data processor, or a component that may facilitate engagement or interaction with second substance communicating device 16. In another example, second substance communicating device 16 may act as an adapter between first substance communicating device 12 and accessory device 22 for communicating a service therebetween. Accessory device 23 may be a consumable reader, including a bar code or RFID tag reader and a microprocessor. Alternatively, a consumable reader may be incorporated into first substance communicating device 12 or second substance communicating device 16 and accessory device 23 may be a sensor for the consumable reader. Accessory device 25 may be a bulk source of consumable 24, such as a large bottle of detergent, which provides second substance communicating device 16 with a replenished supply of consumable 24 as second substance communicating device 16 dispenses a dose of substance 24 into first substance communicating device 12.

System architecture and electronics 15 may include software, not shown, enabling at least one of first substance communicating device 12, second substance communicating device 16, or accessory devices 22, 23 or 25 to discover other devices using network messages.

Referring now to FIG. 2, illustrating schematically more details of second substance communicating device 16, service connector system 18 may include a plurality of service couplers or service connector components 18A-F. Each service connector component may communicate one or more services and may enable one or more functions. For example, substance service connector component 18A may communicate a consumable 24 to second substance communicating device 16, service connector component 18B may communicate a non-consumable substance to second substance communicating device 16, service connector component 18C may communicate the non-consumable substance back to first substance communicating device 12, service connector component 18D may communicate data between first substance communicating device 12 and second substance communicating device 16, service connector component 18E may couple two power contacts of second substance communicating device 16 to two power contacts of first substance communicating device 12, and a service connector component 18F may couple a power takeoff associated with first substance communicating device 12 with a mechanical powered device associated with second substance communicating device 16. Any service communicated through service connectors 18A-18F may be consumed, returned, stored, or passed on to a third device by the device receiving the service. The service may be used to trigger or enable an event, such as to trigger a dispensing event, modify data, or affect a cycle of operation. For example, a mechanical, electrical or data service from first substance communicating device may trigger an actuator in second substance communicating device 16. A substance communicated across a service connector system may be a consumable, a resource or non-consumable substance. Substance and mechanical communication between second substance communicating device 16 and first substance communicating device 12 will normally require a physical coupling. Data, power, illumination, thermal or acoustic communication may require a physical coupling or may occur through a contactless or wireless connection.

In one embodiment, a changed substance is communicated through service connector component 18F. The substance may initial be a resource or a consumable and will have been changed by one of the substance communicating devices prior to being communicated to the other substance communicating device. A changed substance may be one whose properties have been changed by a chemical, thermal, electrical, or other type of process. For example, a changed substance may be one that has been heated, cleaned, cooled, mixed with a consumable, or generally treated in such a way that it has at least one property with a different value.

As mentioned above, service connector component 18E may include a power service connector. A power service connector component may deliver power to a second substance communicating device 16 or it may deliver power to smart process control apparatus 14. The power may be conventional AC at 110 V, DC at 12 V, or another type or amount, such as the power that is transmitted by a USB connection. In some cases, a service connector component may function as both a data and a power source.

Second substance communicating device 16 has an internal source 26' and/or an external source 26" of a consumable 24. If second substance communicating device 16 has the optional process control apparatus 28, as shown in FIG. 2, the process control apparatus 28 may be used for controlling the dispensing or communication of consumable 24 from source 26', or 26".

Second substance communicating device 16 may have components of system software architecture and electronics 15 shown in FIG. 1. For example, as shown in FIG. 2, second substance communicating device 16 may further comprise electronics 30 configured for communication through service connector component 20C with an accessory device such as a consumables reader 36, or through interface or service connector system 18 with smart process control apparatus 14 of first substance communicating device 12 (see FIG. 1). Electronics 30 may affect the operation of the first substance communicating device 12 by communicating with appliance smart process control apparatus 14 when second substance communicating device 16 is in communication with the first substance communicating device 12 through coupling point 18C. Electronics 30 may be configured to deliver a cycle of operation to first substance communicating device 12. Additionally, electronics 30 may be coupled to the process control apparatus 28 of the second substance communicating device 16 to provide additional functionality to substance communication system 10.

Alternatively, electronics 30 may communicate with portions of system software architecture and electronics 15 in the first substance communicating device for the purposes of observing the cycle of operation and modifying the cycle of operation. Electronics 30 may observe the cycle of operation using an appropriate data collection scheme, such as those disclosed in PCT Application Serial Number US2006/

022430, filed 8 Jun. 2006, entitled "Software Architecture System and Method of Communication with, and Management of, at least One Component within a Household Appliance," supported by software of the system software architecture and electronics 15. These data collection schemes include, but are not limited to: requesting data from system software architecture and electronics 15, such as data stored in a data storage device 34 or data processed by the software architecture received from the first substance communicating device 12 such as unsolicited events from the cycle of operation; and creating new events that may be received by communicating with a software architecture having a data acquisition (DAQ), not shown, as disclosed and defined in the above referenced PCT patent application and specifying the events to the DAQ for creation by the DAQ.

In addition, electronics 30 may alter a cycle of operation of one of the devices 12, 16 in response to the observations, such as in the manner described in the above referenced PCT patent application. In a first embodiment, electronics 30 may alter the cycle of operation by requesting software in the system software architecture and electronics 15, so that the smart process control apparatus 14 will enter an alternate operating mode enabling electronics 30 to directly control, partially or wholly, the cycle of operation. In a second embodiment, electronics 30 may alter the cycle of operation by making specific requests to system software architecture and electronics 15. In a third embodiment, the electronics may selectively alter the cycle structure using any of the techniques described herein. Electronics 30 may include a controller 32 and software architecture, not shown, similar to system software architecture and electronics 15 of first substance communicating device 12 and/or a software architecture driver (not shown). Electronics 30 may be powered by second substance communicating device 16 or via connection to the first substance communicating device 12. Electronics 30 may further comprise a client 40. Client 40 may comprise a plurality of arbitrary software components, system software architecture and electronics 15, not shown, an instance of system software architecture and electronics 15, a converter, and any other software and data storage and data access functionality.

It will be appreciated that some or all of the above described components of the electronics 30 may alternatively reside in the first substance communicating device 12 in any accessory or other device in data communication with the second substance communicating device.

The second substance communicating device 16 may also have a consumable reader 36, coupled to second substance communicating device 16 by connector component 20C. In this case, consumable reader 36 is communicatively coupled to the controller 32 and to system software architecture and electronics 15. This enables information about consumable 24 and/or about second substance communicating device 16 to be read from a source of information and transferred into the memory of controller 32 or into the memory of at least one control board within the smart process control apparatus 14 wherein the transferring may be accomplished using system software architecture and electronics 15.

Second substance communicating device 16 may have at least one sensor 38 to sense one or more attributes of a consumable 24 and/or its source 26' or 26". Attributes may include, but are not limited to, amount, brand, type, composition, structural form, expiration date, dispensing properties, nutritional information, temperature, pressure, and concentration. To store and inventory such data, second substance communicating device 16 may utilize controller 32. Such information or data may also be conveyed to and/or presented at a user interface in second substance communicating device 16 or first substance communicating device 12.

Process control apparatus 28 of second substance communicating device 16 may be configured to detect functionalities of first substance communicating device 12, modify functionalities of first substance communicating device 12, be controlled by first substance communicating device 12, be controlled by electronics 30, or otherwise exchange data with the smart process control apparatus 14 of first substance communicating device 12 either directly through one or more coupling points of service connector system 18 or indirectly through electronics 30 coupled to the first substance communicating device 12 through connector component 18C. Process control apparatus 28 may be used for the transmission, dispensing, supplying, or usage of at least one consumable 24 by responding to control signals resulting in the actuating of a mechanical part, such as a valve, conduit, solenoid, sensor, actuator, spring, transmission, motor, or gear, not shown. Additionally, smart process control apparatus 28 may be configured to modify properties of one or more consumables or resources such as temperature or a chemical property. For example, temperature could be raised by actuating a heater, and chemical properties might be changed by controlling a mixture of at least two consumables and/or resources by using a motor and an auger. Additional auxiliary functionalities not directly related to consumables 24 may be enabled by process control apparatus 28. Process control apparatus 28 may optionally include a mechanism to affect the use of a resource, such as an actuator for a valve.

Second substance communicating device 16 may receive resources from first substance communicating device 12, act on the resources, and return the modified resources to the appliance. For example, in a washing machine or dishwasher, second substance communicating device 16 may receive water from first substance communicating device 12 and return that water to first substance communicating device 12 as grey water or as water mixed with detergent. In this instance, detergent would be consumable 24. Second substance communicating device 16 may thus export modified consumables 24 which have either been operated on by second substance communicating device 16 or that have been operated on by the introduction of at least one resource. Second substance communicating device 16 may also dispense consumable 24 directly to first substance communicating device 12.

Client 40 in electronics 30 may contain a data set linking the model of first substance communicating device 12 or some other functional identifier such as a class identification, or an application programming interface (API) identification type, and/or version to the consumables 24 that second substance communicating device 16 may contain. The data set may further link any of these attributes to a plurality of cycles of operation for first substance communicating device 12. The data set may also link cycle modification or cycle operation data or cycle structure data or data for response to a query message to various combinations of appliances (used as first substance communicating device 12), consumables 24, and selected cycles. The data set may alternatively be in first substance communicating device 12. The data in the data set may be modified by a message sent by one of the constituents of the substance handling system 10, such as second substance communicating device 16, consumable 24, consumable reader 36, or accessory devices 22, 23, and 25.

Figure 3:
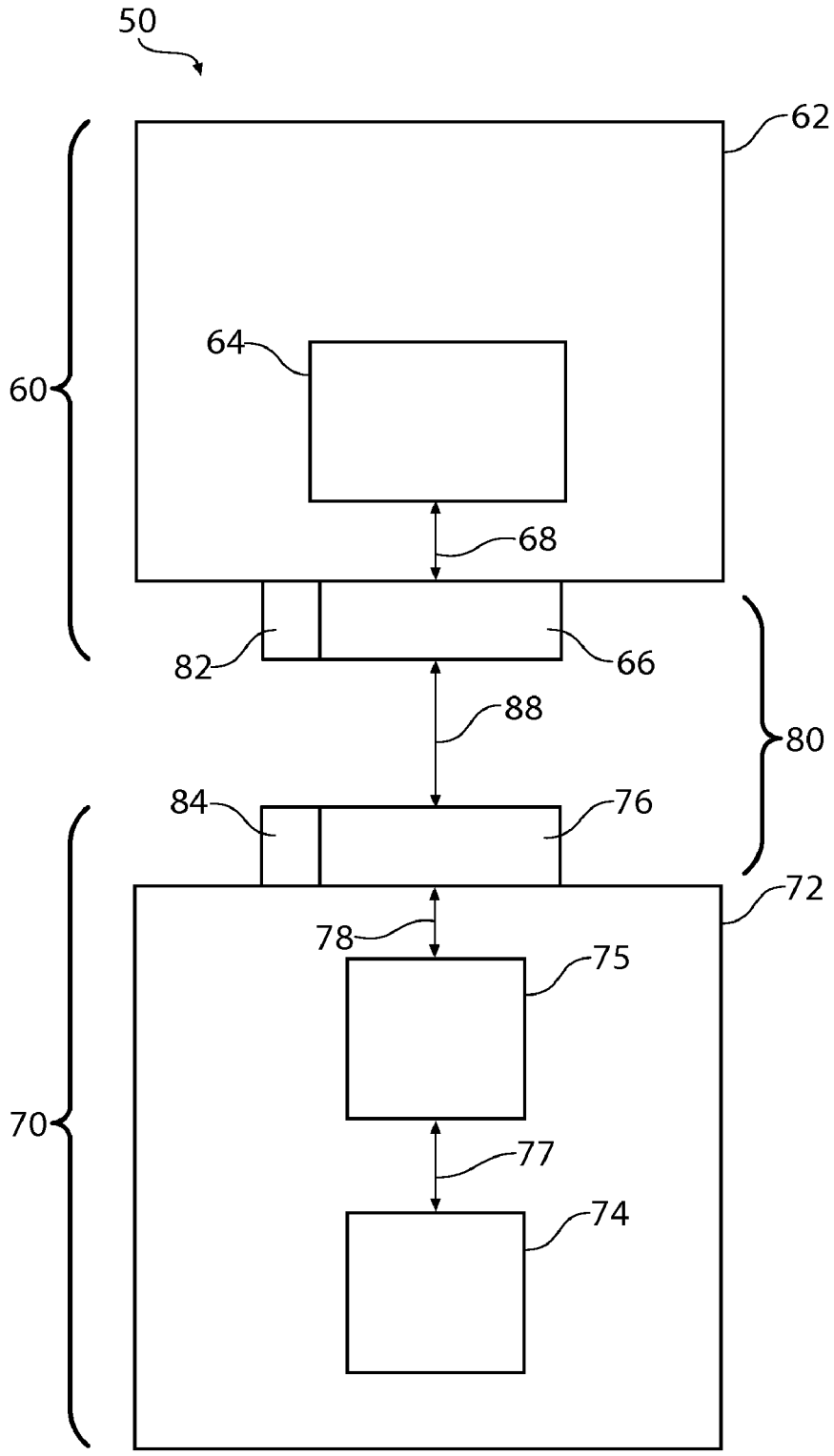
FIG. 3 is a schematic illustration of a service supply and consumption system.

Referring to FIG. 3, a more general example of a service supply and consumption system 50 is schematically illustrated. A first service communicating device 60 is connectable to a second service communicating device 70 for selectively communicating a service therebetween. First service communicating device 60 may comprise a host 62, such as an appliance, having a service consumer 64 connected to a first service connector component, such as a plug 66, by means of a service line 68. Second service communicating device 70 may comprise an accessory device 72 having a service source or service provider 74 connected to a second service connector, such as a receptacle 76, by service lines 77 and 78 regulated by a switching valve 75. In one utilization, the service being communicated may be a substance, and the service consumer 64 is a substance consumer while the service provider 74 is a substance provider and the accessory device comprises a substance holder. In another utilization, the service being communicated may be an electromagnetic service. In yet another utilization, both a substance and an electromagnetic service may be communicated.

A service connector system 80 includes plug 66 and receptacle 76, which are selectively interengageable. A switch component 82 is associated with host 62 and a switch component 84 is associated with accessory device 72. For example, switch components 82 and 84 may include switches, actuators, connectors, links, and plates, etc. Switch components 82 and 84 are selective engageable to selectively activate switching valve 75 when plug 66 and receptacle 76 are engaged, to permit the transfer of the service, as shown at 88, from substance provider 74 to receptacle 76, which may then be subsequently transferred along service line 68 to service consumer 64.

It will be appreciated that while accessory device 72 is illustrated as including a service provider 74 and host 62 is illustrated as including a service consumer 64, host 62 may alternatively or additionally include a service provider and accessory device 72 may alternatively or additionally include a service consumer. It will further be appreciated that while only a single service consumer 64 and a single service provider 74 are shown, it is understood that more than one service consumer and service provider may be included, such as one set for communicating a substance and one set for communicating an electromagnetic service. It will further be appreciated that while plug 66 is illustrated as being associated with substance consumer 64 and receptacle 76 is illustrated as being associated with service provider 74, it is contemplated that plug 66 and receptacle 76 may be male or female connector components so long as the components are capable of interengaging to permit the transfer of substance therebetween.

Figure 4:
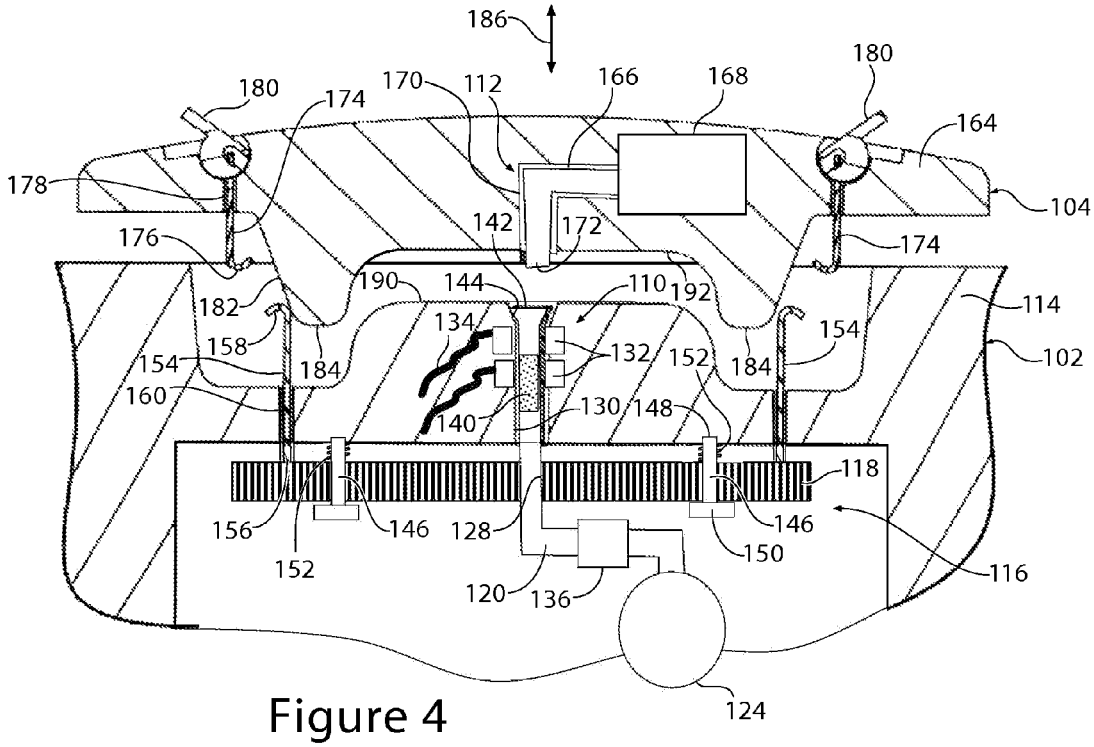
FIG. 4 is a partial cross-sectional view of a mechanically energized substance communication coupling system, showing a first substance communicating device positioned for engagement with a second substance communicating device.
Figure 5:
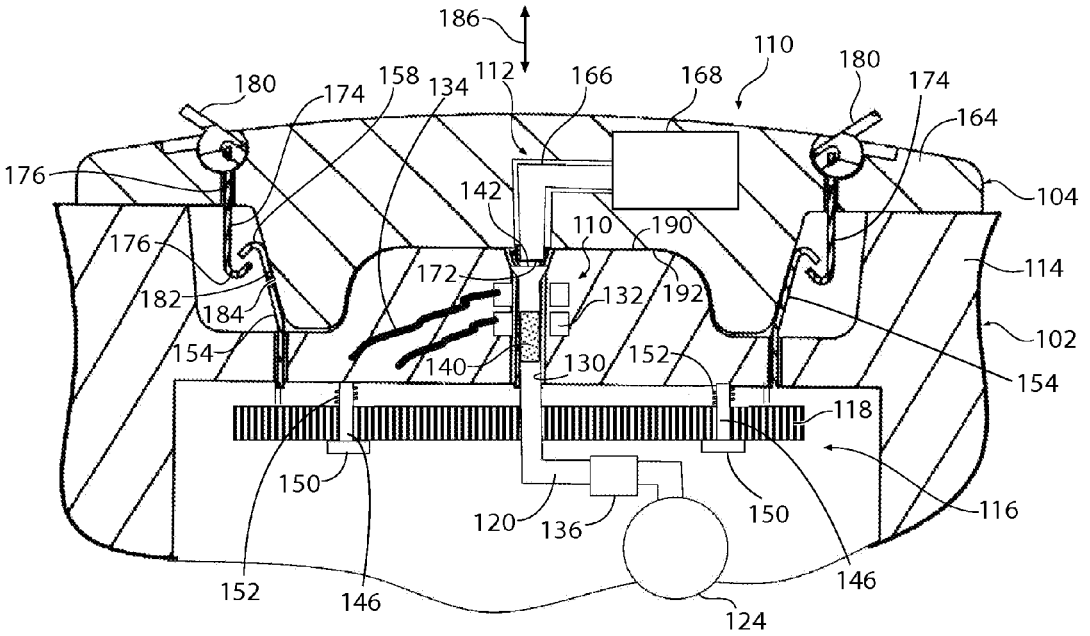
FIG. 5 is a partial cross-sectional view similar to FIG. 4, showing the first substance communicating device engaged with the second substance communicating device, the substance communication coupling system being arranged in an unlatched state.

Referring to FIGS. 4 and 5, a more specific example of a substance communicating system is illustrated, and includes a first substance communicating device 102 having a first substance connector component 110 and a second substance communicating device 104 having a second substance connector component 112. First substance connector component 110 and second substance connector component 112 have complementary configurations that enable the substance connector components to be coupled to one another, thereby establishing a substance pathway over which desired substances may be transferred between first substance communicating device 102 and second substance communicating device 104. Together, first substance connector component 110 and second substance connector component 112 comprise a substance communication connector system. Substance connector components 110 and 112 may be integrally formed with second substance communicating device 104 and first substance communicating device 102, respectively, or may be an add-on devices.

First substance connector component 110 can be integrally formed with first substance communicating device 102 or may be an add-on device. When configured as an add-on component, first substance connector component 110 may also function as an adapter to enable a host and an accessory device having dissimilar substance communication coupling systems to be indirectly coupled to one another. First substance connector component 110 may be removable or non-removable. For purposes of discussion, first substance connector component 110 is shown integrally formed with first substance communicating device 102.

First substance connector component 110 may be enclosed within a housing 114. Housing 114 may be an integral part of first substance communicating device 102 or may be a separate component. For purposes of discussion, housing 114 is illustrated as an integral part of first substance communicating device 102, and more particularly as part of the door of a refrigerator. First substance connector component 110 can be configured to transfer or receive a single substance or multiple substances.

First substance connector component 110 may include a mechanically actuated service switch 116, described below, which can be selectively actuated to establish a substance pathway between first substance communicating device 102 and second substance communicating device 104 when second substance communicating device 104 is coupled to first substance communicating device 102. In addition, first substance connector component 110 and second substance connector component 112 may also provide a mechanism, described below, for mechanically securing second substance communicating device 104 to first substance communicating device 102.

Service switch 116 may be enclosed within a housing, such as housing 114. Service switch 116 includes a switch plate 118 movable between an open position (see FIG. 4) and closed position (see FIG. 6), in a manner to be described later in detail, to enable a substance to be selectively transferred between first substance communicating device 102 and second substance communicating device 104 when second substance communicating device 104 is coupled to first substance communicating device 102. Service switch 116 is generally disposed in the open position when second substance communicating device 104 is decoupled from first substance communicating device 102.

First substance connector component 110 may include a substance communication line 120 operable for facilitating transfer of a substance to and from first substance communicating device 102. For purposes of discussion, substance communication line 120 is illustrated generically as a tube-like structure. The generically illustrated configuration is not intended to depict any particular configuration, but rather schematically represents a variety of potentially different configurations. In practice, the actual configuration will likely vary depending, at least in part, on the type of substance being transferred, the pressure at which the substance is being transferred and manufacturing considerations. It shall be appreciated that substance communication line 120 may include other configurations to accommodate various design considerations.

As best shown generally in FIG. 4, substance communication line 120 is in communication at one end to a supply of substance, such as a substance provider 124. Substance communication line 120 extends through an aperture 128 in switch plate 118 and is attached to switch plate 118, such as by welding, brazing, gluing, or any other suitable fixturing method to be selectively movable by switch plate 118. Substance communication line 120 extends from switch plate 118 into a passageway 130 extending through housing 114. Passageway 130 is sized to be slightly larger than substance communication line 120 to allow substance communication line 120 to be moved freely by switch plate 118 along a length of passageway 130.

A proximity sensor, such as electrical contacts 132, may be provided in housing 114 and extend into passageway 130 to sense the position of substance communication line 120. For example, housing 114 may be made of dielectric material and electrical contacts 132 may be spaced apart rings of conductive material molded into housing 114. Each of the contacts 132 may be connected by an electrical line 134 to a control circuit, not shown, responsive to the creation of an electrical connection between contacts 132 to operate a flow regulating component 136, which is capable of selectively inhibiting the flow of substance from substance provider 124 to substance communication line 120. Flow regulating component 136 may more specifically be a substance flow regulating component, such as a pump.

A proximity target, such as a conductive surface 140 formed on the exterior of substance communication line 120, is selectively engageable with the electrical contacts 132 to complete a circuit between the electrical contacts 132 and thereby permit the proximity sensor to detect the repositioning of substance communication line 120 in the passageway 130 and operate flow regulating component 136. Substance communication line 120 may be formed of a dielectric material and conductive surface 140 may be formed from a conductive foil or coating applied to the exterior surface of substance communication line 120 or a conductive ring molded into substance communication line 120.

The distal end 142 of substance communication line 120 may be tapered outwardly and cooperates with a chamfered open end 144 of passageway 130 opening to the exterior of housing 114 to restrict the removal of substance communication line 120 from passageway 130. Distal end 142 of substance communication line 120 forms a receptacle able to operably engage a corresponding substance terminal of second substance communicating device 104, described below, when the second substance communicating device 104 is coupled to first substance communicating device 102. It will be appreciated that portions of housing 114 cooperate with the distal end 142 of substance communication line 120 to define a receptacle for coupling with a plug, described below.

Switch plate 118 is slidably mounted to at least one guide rod 146. As illustrated herein, switch plate 118 is mounted to a pair of spaced guide rods 146. An end 148 of each guide rod 146 can be fixedly attached to housing 114. An opposite end of each guide rod 146 may include a stop 150, which can be sized larger than the opposite end to prevent switch plate 118 from traveling past the stop 150. A biasing member 152 may be disposed between housing 114 and switch plate 118 to urge switch plate 118 toward stop 150. As illustrated herein, two biasing members 152 in the form of springs are disposed about guide rods 146.

Service switch 116 further includes at least one actuating link 154 fixedly attached to switch plate 118 at one end 156 of actuating link 154. Actuating link 154 extends from switch plate 118 through an aperture 160 in housing 114 and has a hook-shaped portion 158 disposed at its distal end outside of the housing 114. Hook-shaped portion 158 allows actuating link 154 to selectively connect to a corresponding actuating link 174, described below, associated with second substance communicating device 104. Sufficient clearance is provided between actuating link 154 and aperture 160 to allow actuating link 154 to move freely in and out of the housing and thereby move switch plate 118 to move substance communication line 120 along aperture 128. First actuating link 154 may be constructed of a flexible material having a relatively high modulus of elasticity, such as spring steel, or another generally flexible material having similar mechanical properties.

Second substance connector component 112 can be integrally formed with second substance communicating device 104 or may be an add-on component. As described above, it may be directly integrated into an accessory device or instead integrated into an adapter to which an accessory device is in turn mounted. For purposes of discussion, second substance connector component 112 is shown integrally formed with second substance communicating device 104. When configured as an add-on component, second substance connector component 112 may also function as an adapter to enable a host and a portable device having dissimilar substance communication connector systems to be indirectly coupled to one another. Second substance connector component 112 may be removable or non-removable from second substance communicating device 104. Second substance connector component 112 may be configured to transfer or receive a single substance or multiple substances and may also be configured to transfer additional services such as electrical power, mechanical power, data, illumination, sound or heat.

Second substance connector component 112 may be enclosed within a housing 164. Housing 164 may be an integral part of second substance communicating device 104 or may be a separate component. For purposes of discussion, housing 164 is illustrated as an integral part of second substance communicating device 104.

Second substance connector component 112 may include a substance communication line 166 operable for transferring a substance to and from second substance communicating device 104. For purposes of discussion, substance communication line 166 is illustrated generically in FIG. 4 as tube-like structure. The generically illustrated configuration is not intended to depict any particular configuration, but rather schematically represents a variety of potentially different configurations. In practice, the actual configuration will likely vary depending, at least in part, on the type of substance being transferred, the pressure at which the substance is being transferred and manufacturing considerations. It shall be appreciated that substance communication line 166 may include other configurations to accommodate various design considerations.

Substance communication line 166 is in communication at one end with a substance consumer 168. Substance communication line 166 is fitted through an aperture 170 in housing 164 and terminates in an exposed end 172 disposed outside of housing 164. Substance communication line 166 is fastened, secured or molded into housing 164 so as to move with housing 164. It will be appreciated that the exposed end 172 of substance communication line 166 cooperates with portions of housing 164 to form a plug engageable with a receptacle formed by the cooperation of housing 114 with the distal end 142 of substance communication line 120.

Second substance connector component 112 may include at least one second actuating link 174 that can connect to first actuating link 154 of first substance connector component 110 when second substance communicating device 104 is coupled to first substance communicating device 102. Second actuating link 174 may include a hook-shaped portion 176 that can be coupled to the corresponding hook-shaped potion 158 of first actuating link 154. An opposite end 178 of second actuating link 174 can be operably connected to a switch component such as toggle switch 180, or similar device. Toggle switch 180 can be moved between an unlatched position, shown in FIGS. 4 and 5, and a latched position, shown in FIG. 6.

It will be appreciated that first substance connector component 110 and second substance connector component 112 may include various geometric features to facilitate coupling of second substance communicating device 104 to first substance communicating device 102. For example, first substance connector component 110 may include a raised boss 190 that can engage a corresponding recess 192 of second substance connector component 112. A raised ridge 184 at least partially defines an outer boundary of recess 192. Alignment features such as boss 190 and recess 192 may assist with positioning of second substance connector component 112 relative to first substance connector component 110 prior to engagement, and may also function to minimizing lateral movement of second substance communicating device 104 relative to first substance communicating device 102 when first substance connector component 110 is coupled to second substance connector component 112. It shall be appreciated, however, that the illustrated configuration is merely one example of the type of features that may be incorporated into first substance connector component 110 and second substance connector component 112 to aide alignment and coupling of second substance communicating device 104 to first substance communicating device 102. In practice, other configurations may also be employed to accommodate various design considerations of a particular application.

To facilitate coupling and decoupling of second actuating link 174 with first actuating link 154, second actuating link 174 can be offset laterally relative to first actuating link 154 to allow hook-shaped portion 176 of second actuating link 174 to clear hook-shaped portion 158 of the first actuating link 154 when second substance communicating device 104 is attached to first substance communicating device 102. For example, referring particularly to FIG. 4, with second substance communicating device 104 positioned for engagement with first substance communicating device 102, hook-shaped portion 158 of first actuating link 154 is initially offset from hook-shaped portion 176 of second actuating link 174. As first substance connector component 110 is moved into engagement with second substance connector component 112, as shown in FIG. 5, end 158 of first actuating link 154 engages an inclined surface 182 of ridge 184. Surface 182 is inclined relative to an engagement path denoted by arrow 186. Arrow 186 depicts a path along which second substance communicating device 104 can be moved when coupling and decoupling second substance communicating device 104 to and from first substance communicating device 102. Further movement of first substance connector component 110 toward second substance connector component 112 causes end 158 of actuation link 154 to travel along inclined surface 182, which in turn elastically displaces end 158 of first actuating link 154 toward end 176 of second actuating link 174. With first substance connector component 110 fully engaged with second substance connector component 112 (see FIG. 5), hook-shaped portion 158 of first actuating link 154 is sufficiently displaced from its decoupled position (see FIG. 4) so as to axially overlap hooked-shaped portion 176 of second actuating link 174. Moving toggle switch 180 from the unlatched to the latched position retracts second actuating link 174 (see FIG. 6).

Actuating link 174 and/or toggle switch 180 may, alone or in combination with each other or with actuating link 154, be considered to be an actuator engageable with the service switch 116 for actuating the service switch 116 and establishing a substance pathway between first substance communicating device 102 and second substance communicating device 104.

The process is reversed when disengaging second substance communicating device 104 from first substance communicating device 102. As first substance connector component 110 is disengaged from second substance connector component 112, hook-shaped portion 158 of actuation link 154 slides along inclined surface 182 and is moved out of alignment with hooked-shaped portion 176 of second actuating link 174, as shown in FIG. 4. Moving toggle switch 180 from the latched position to the unlatched position causes second actuating link 174 to be extended. Second actuating link 174 may be constructed of a similar material as first actuating link 154.

Coupling of second substance communicating device 104 to first substance communicating device 102 can be accomplished by positioning second substance communicating device 104 adjacent first substance communicating device 102 in such a manner that first substance connector component 110 is generally aligned with second substance connector component 112, as shown in FIG. 4. First substance connector component 110 and second substance connector component 112 can be coupled together by generally moving second substance communicating device 104 toward first substance communicating device 102 along the path indicated by arrow 186 until the two members are fully seated, as shown in FIG. 5. With first substance connector component 110, fully engaging second substance connector component 112, end 172 of substance communication line 166 aligns with end 142 of substance communication line 120. However, since service switch 116 has not yet been activated, the substance communication path between second substance communicating device 104 and first substance communicating device 102 remains incomplete and the supply of substance to substance communication line 120 remains closed.

Figure 6:
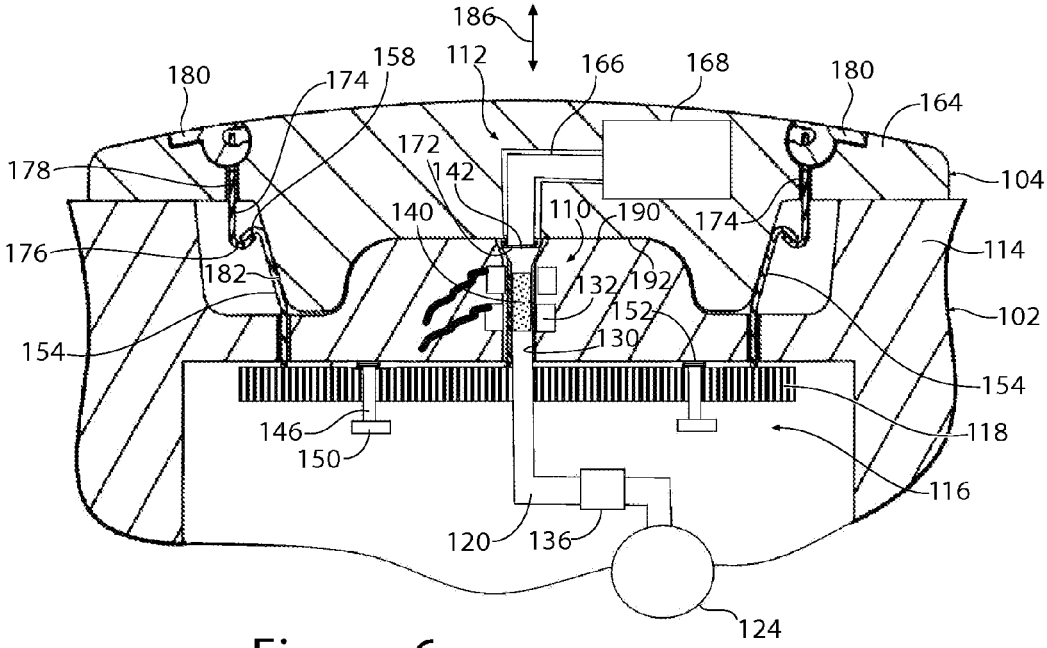
FIG. 6 is a partial cross-sectional view similar to FIG. 4, showing the first substance communicating device engaged with the second substance communicating device, the substance communication coupling system being arranged in a latched state.

Service switch 116 can be activated by moving toggle switch 180 to the latched position, as shown in FIG. 6. Doing so causes hook-shaped portion 176 of second actuating link 174 to engage hook-shaped portion 158 of first actuating link 154, which in turn results in first actuating link 154 being pulled toward second substance communicating device 104 by second actuating link 174. Switch plate 118 and substance communication line 120 are pulled along with second actuating link 174 and first actuating link 154 towards housing 164, causing end 172 of substance communication line 166 to engage with end 142 of substance communication line 120, effectively completing the formation of a substance communication path between second substance communicating device 104 and first substance communicating device 102.

Furthermore, as substance communication line 120 is advanced into engagement with substance communication line 166, the proximity sensor, represented by electrical contacts 132 on the inner walls of passageway 130 is engaged by the proximity target, represented by the conductive surface 140 on the outer walls of the passageway 130 to complete a circuit and permit flow regulating component 136 to open and permit the flow of substance from the substance provider 124.

It should be noted that service switch 116 is intended to selectively permit and inhibit flow of substance from the substance provider 124 to the substance communication line 120 based on the presence of a proximity target associated with substance communication line 120. Alternative sensors and targets may be used for this purpose. It should further be noted that the proximity sensor is intended to deliver a signal or message selectively permitting or selectively inhibiting the flow of substance to substance communication line 120 and that the signal represented in the drawings and described above as the completion of an electrical circuit is merely one example of various signals or messages that may be used for this purpose. It should also be noted that additional valves and controls, besides those represented in the drawings and described herein, may be provided to further regulate the flow of substance based on the needs of the user of the second substance communicating device 104.

Service switch 116 can be deactivated by moving toggle switch 180 from the latched position, as shown in FIG. 6, to the unlatched position, as shown in FIG. 5. Doing so causes hook-shaped portion 176 of second actuating link 174 to disengage hook-shaped portion 158 of first actuating link 154. Releasing first actuating link 154 allows biasing member 152 to move switch plate 118 toward stops 150 of guide rods 146. Substance communication line 120 is pulled along with switch plate 118 away from housing 164, causing end 172 of substance communication line 166 to disengage with end 142 of substance communication line 120, effectively terminating the substance communication pathway between second substance communicating device 104 and first substance communicating device 102. Furthermore, as substance communication line 120 retreats from engagement with substance communication line 166, the proximity sensor, represented by electrical contacts 132 on the inner walls of passageway 130, disengages the proximity target, represented by the conductive surface 140 on the exterior of substance communication line 120, to interrupt the circuit powering flow regulating component 136, causing flow regulating component 136 to close and interrupt the flow of substance from the substance provider 124.

Once toggle switch 180 has been moved to the unlatched position, second substance communicating device 104 can be removed from first substance communicating device 102 by withdrawing second substance communicating device 104 from first substance communicating device 102 along a path generally parallel to the path defined by arrow 186. Furthermore, as substance communication line 120 is retracted from engagement with substance communication line 166, the proximity sensor, acts to inhibit flow regulating component 136 from opening to permit the flow of substance from the substance provider 124.

Figure 7:
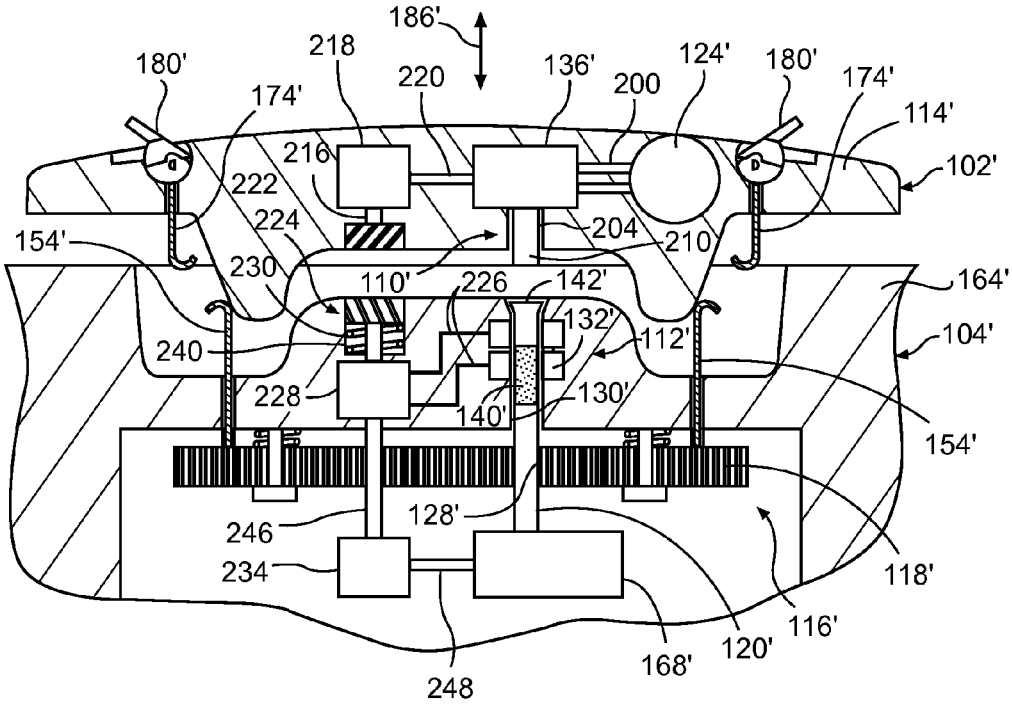
FIG. 7 is a partial cross-sectional view of an alternate substance communication coupling system, showing a first substance communicating device positioned for engagement with a second substance communicating device.

Referring to FIG. 7, an alternative embodiment of a substance communicating system is illustrated, where elements in common with the embodiment shown in FIGS. 4 through 6 are denoted by the same reference numeral bearing a prime (') symbol. The system and includes a first substance communicating device 102' and a second substance communicating device 104' which are similar to first substance communicating device 102 and a second substance communicating device 104 described above with reference to FIGS. 4 through 6, with some exceptions. In particular, as will be described below, first substance communicating device 102' and second substance communicating device 104' each have two service connector components and a mechanically actuated service switch 116' is provided in the second substance communicating device 104' whereas the switch 116 was in the first substance communicating device 102' in the previously described embodiment. This configuration may be used, for example, when the substance consumer is an appliance that is connected to a residential power supply and the substance provider is an accessory device without an independent source of power. In this case, the appliance could be a washing machine and the accessory could be a detergent dispenser.

To avoid confusion, please note that the second substance communicating device 104' is shown below the first substance communicating device 102' in FIG. 7, the reverse of the configuration shown in FIGS. 4 through 6.

First and second substance connector components 110' and 112' are respectively incorporated into first and second substance communicating devices 102' and 104'. First substance communicating device 102' has a substance provider 124' connected by a first substance line 200 through a first flow regulating component 136', such as a switching valve or a pump, to a second substance line 204 terminating in an exposed end 210. Exposed end 210 of second substance line 204 acts as a substance interface for first substance connector components 110'. Second substance communicating device 104' has a substance consumer 168' connected to a substance line 120' extending through an aperture 128' in a switch plate 118' and a passageway 130' in a housing 164' of second substance communicating device 104' and terminating at an exposed end 142'. Exposed end 142' of substance line 120' acts as a substance interface for second substance connector components 112' and is engageable with the exposed end 210 of second substance line 204 for selectively establishing a substance pathway over which desired substances may be transferred between the first substance communicating device 102' and the second substance communicating device 104'.

Second substance communicating device 104' has a mechanically actuated service switch 116' having a switch plate 118' movable between a lower position, as shown, and a raised position, not shown, by operation of toggle switches 180' in a similar manner to that described above with reference to service switch 116 shown in FIGS. 4 through 6. Substance line 120' is coupled to switch plate 118' so as to be movable along with switch plate 118' into engagement with substance line 204. Substance line 120' is provided with a conductive surface 140' engageable with contacts 132' to selectively provide a connection between contacts 132'. In a manner similar to that described above with reference to FIG. 6, when first substance connector component 110' is coupled to second substance connector component 112', the operation of toggle switches 180' will operate to raise switch plate 118', and thereby raise substance line 120'.

Actuating link 174' and/or toggle switch 180' may, alone or in combination with each other or with actuating link 154', be considered to be an actuator engageable with the service switch 116' for actuating the service switch 116' and establishing a substance pathway between first substance communicating device 102' and second substance communicating device 104'.

First substance communicating device 102' further has a first electromagnetic connector component 222 and second substance communicating device 104' has a second electromagnetic connector component 224. First and second electromagnetic connector components 222 and 224 have complementary configurations that enable the electromagnetic connector components to be coupled to one another, thereby establishing a electrical pathway over which power or data may be transferred between first substance communicating device 102' and second substance communicating device 104'. It will be appreciated that wired power, wireless power, wired data, or wireless data may be communicated between the electromagnetic connector components 222 and 224. Together, first and second electromagnetic connector components 222 and 224 comprise an electromagnetic communication coupling system.

First electromagnetic connector component 222 may be enclosed within housing 114' of first substance communicating device 102'. First electromagnetic connector component 222 may be removable or non-removable from first substance communicating device 102'. First electromagnetic connector component 222 may be configured to transfer or receive power, data or both.

First electromagnetic connector component 222 may be connected by electrical lines 216 to a controller 218 which in turn may be connected by electrical lines 220 to flow regulating component 136'. Controller 218 may control the operation of flow regulating component 136' in response to an electrical service received by first electromagnetic connector component 222. Alternatively, controller 218 may be omitted and electrical lines 220 may be directly coupled to electrical lines 216, whereby flow regulating component 136' may be directly regulated by an electrical power or data signal, which may be communicated through first electromagnetic connector component 222 when connected to second electromagnetic connector component 224.

Second electromagnetic connector component 224 may be enclosed within housing 164' of second substance communicating device 104'. Second electromagnetic connector component 224 may be removable or non-removable from second substance communicating device 104'. Second electromagnetic connector component 224 may be configured to transfer or receive power, data or both. Second electromagnetic connector component 224 may be provided with a biasing member 240 biasing second electromagnetic connector component 224 away from housing 164' to facilitate a reliable connection with a first electromagnetic connector component 222.

Second electromagnetic connector component 224 may be connected by electrical lines 230 to a controller 228 configured to selectively permit the communication of electromagnetic service through second electromagnetic connector component 224. In a first embodiment, controller 228 is connected by electrical lines 226 to contacts 132' and by electrical line 230 to second electromagnetic connector component 224 to provide an electromagnetic service in the form of data or power to second electromagnetic connector component 224 when substance line 120' is raised sufficiently to provide an electrical path along surface 140' between contacts 132'. Controller 228 may then control the communication of data and power along lines 216 in response to this signal by switching power on or off from a power supply, not shown, or by providing a data signal to lines 230. Surface 140' cooperates with contacts 132' to act as a switch, and controller 228 may, in response to the detection of the closing of that switch, control the communication of data and power to second electromagnetic connector component 224.

Alternatively, controller 228 may provide a control voltage on one of the electrical lines of 226 and may include sensing, such as current flow sensing, so that when surface 140' creates continuity and a circuit is formed between controller 228, electrical lines 226, contacts 132' and surface 140', a control signal may be generated and used to control the communication of data and power to second electromagnetic connector component 224.

Alternatively, controller 228 may provide a power or data to second electromagnetic connector component 224 at other times, but may also provide a signal indicative of the displacement of the substance line 120'.

Alternatively, electrical line 230 may be directly connected to lines 226 so as to directly supply an electromagnetic service of power and/or data to second electromagnetic connector component 224 from a power supply, not shown, in electrical series with the contacts 132'. In this embodiment, substance line 120' acts directly as a power switch to directly permit the flow of electromagnetic service through second electromagnetic connector component 224.

Still another alternative omits controller 228 and the power supply, not shown, from communication with these components and instead connects 132' directly with second electromagnetic connector component 224 as an unpowered connection. In this alternative configuration, controller 218 in the first substance communicating device 102' detects the proper positioning of substance line 120' by detecting the closing of a circuit including electrical lines 216, 230 and 226, which will only occur when the first and second electromagnetic connector components 222 and 224 are coupled and substance line 120' has been raised.

Alternatively, or additionally, lines 226 may be directly or indirectly connected, such as by electrical lines 246, to a controller 234 for controlling substance consumer 168'. Controller 234 may, in turn, be connected to substance consumer 168' by electrical lines 248. Controller 234 may control substance consumer 168' in response to this signal. In this embodiment, controller 234 may also regulate the communication of service to first electromagnetic connector component 222. Controller 234 may also communicate with controllers 218 or 228 to regulate the integrated operation of first and second substance communicating devices 102' and 104'.

In still another alternative, not shown, second electromagnetic connector component 224 is coupled to switch plate 118' so that second electromagnetic connector component 224 may be raised into engagement with first electromagnetic connector component 222 by operation of toggle switches 180'.

In yet another alternative, not shown, either controller 218 or 228 may be omitted and the other controller 228 or 218 may regulate the communication of power or data between the first and second substance communicating devices 102' and 104'.

In yet another alternative, not shown, surface 140' could be a proximity target and a proximity sensor could be associated with line 204 in substance communicating device 102' such that when substance lines 120' and 204 inter-engage, the proximity sensor is triggered by the proximity target resulting in control signal communication between the proximity sensor and the flow regulating device 136', thereby using an actuator, such as toggle switches 180', to selectively permit substance communication between the first and second substance communicating devices 102' and 104'.

Flow regulating component 136', which may be a normally closed valve requiring power to be opened or a pump requiring power to operate, acts to prevent the communication of substance from first substance communicating device 102'. Similarly, another type of normally open proximity switch may be substituted for contacts 132' and surface 140' for controlling the communication of electromagnetic service through first and second electromagnetic connector components 222 and 224, which, in turn, is used to control the communication of substance through first and second substance connector components 110' and 112'.

For some implementations, controller 234 may selectively operate second flow regulating component, not shown, associated with substance consumer 168' in response to one of the switching alternatives described above. Controllers 218, 228 and 234 may be embodied in a plurality of designs and configurations. In one configuration, any or all of controllers 218, 228 and 234 may include relays with one or more contacts pairs for wiring auxiliary circuits where the continuity of the circuit is determined by the state of the relay coil being either energized or de-energized. In another configuration, any or all of controllers 218, 228 and 234 may include micro-processors with appropriate signal conditioning circuitry for electrically interfacing with other electrical components. In addition, there are many system design options for controllers 218, 228 and 234. In some cases one or more elements of 218, 228, and 224 or their sub-elements may be eliminated, substituted, or combined to accomplish the selective substance communication between the first and second substance communicating devices 102' and 104'.

It will be appreciated that in implementations where controllers 218, 228, and/or 234 are used, these controllers form a part of the system software architecture and electronics 15 described above with reference to FIGS. 1 and 2 and may incorporate portions of, for example, process control apparatus 14 or 28.

With regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In summary, it should be understood that the invention is capable of modification and variation and is limited only by the following claims.

All defined terms used in the claims are intended to be given their broadest reasonable constructions consistent with the definitions provided herein. All undefined terms used in the claims are intended to be given their broadest reasonable constructions consistent with their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A substance communicating device for use in conjunction with an appliance having a first substance connector component and a first switch component, the substance communicating device comprising:

a main body;

a substance consumer associated with the main body;

a substance line having a first end coupled with the substance consumer and a second end remote from the first end;

a second substance connector component operably coupled with the second end of the substance line, the second substance connector component being operably actuatable by the first substance connector component to permit the communication of a substance between the first and second substance connector components; and a second switch component being configured to actuate the first switch component when the first substance connector component is adjacent with the second substance connector component to selectively draw the first and second substance connector components into engagement and to selectively permit the communication of the substance between the substance communicating device and the appliance.

2. The consumable substance communicating device according to claim 1, wherein the second switch component is configured to engage the first switch component when the first and second substance connector components are engaged to selectively permit the communication of the substance between the substance communicating device and the appliance.

3. The substance communicating device according to claim 1, wherein the second switch component mechanically engages the first switch component to selectively draw the first and second substance connector components into engagement.

4. The substance communicating device according to claim 1 and further comprising a service switch operable by one of the first and second substance connector components to selectively permit the communication of the substance between the substance communicating device and the appliance through the service switch after the first and second substance connector components are engaged.

5. The substance communicating device according to claim 1 and further comprising a service switch operable by one of the first and second substance connector components to selectively permit the communication of a plurality of services, including the substance, between the substance communicating device and the appliance through the service switch after the first and second substance connector components are engaged.

6. The substance communicating device according to claim 1 and further comprising a substance flow regulating component.

7. The substance communicating device according to claim 1, wherein the first switch component is a switch and the second switch component is an actuator engageable with the switch to actuate the switch when the first substance connector component is adjacent the second substance connector component.

8. The substance communicating device according to claim 1, wherein the substance communicating device comprises at least one of a dispenser, a filter, a water filter, an air filter, a detergent dispenser, a drink dispenser, a detergent cartridge, a bottle, a jug, a flavoring dispenser, a steam dispenser, a fragrance dispenser, a food ingredient dispenser, a cycle accessory, and a chemistry dispenser.

9. The substance communicating device according to claim 1, wherein the appliance further comprises a first electromagnetic service connector component, and the substance communicating device further comprises:

a second electromagnetic service connector component operably engageable with the first electromagnetic service connector component to permit the communication of an electromagnetic service between the first and second electromagnetic service connector components.

10. The substance communicating device according to claim 9, wherein the second substance connector component comprises the second electromagnetic service connector component.

11. The substance communicating device according to claim 9, wherein the second electromagnetic service connector component is configured to engage the first electromagnetic service connector component when the first and second substance connector components are engaged to selectively permit the communication of the substance and the electromagnetic service between the substance communicating device and the appliance.

12. The substance communicating device according to claim 10, wherein the second switch component is configured to engage the first switch component when the first and second substance connector components are engaged to selectively permit the communication of the substance and the electromagnetic service between the substance communicating device and the appliance.

13. The substance communicating device according to claim 9, and further comprising a switch operable to selectively permit the communication of the substance between the first and second substance connector components only when electromagnetic service is communicated between the first and second electromagnetic service connector components.

14. A system comprising:

an appliance having a first service connector component;

a substance communicating device having a second service connector component operably engageable with the first service connector component;

a service switch operably associated with one of the first and second service connector components, the switch being configured to selectively permit the communication of a service between the substance communicating device and the appliance; and an actuator associated with the other of the first and second service connector components, the actuator being configured to selectively actuate the service switch when the first service connector component is adjacent the second service connector component to selectively draw the first and second service connector components into engagement to permit the communication of the service between the substance communicating device and the appliance.

15. The system according to claim 14, wherein the service switch is operably associated with the first service connector component and the actuator is operably associated with the second service connector component.

16. The system according to claim 14, wherein the service switch is operably associated with the second service connector component and the actuator is operably associated with the first service connector component.

17. The system according to claim 14, wherein the service comprises a substance service, and further wherein the substance communicating device comprises a substance holder.

18. The system according to claim 14, wherein the actuator mechanically engages the service switch to selectively draw the first and second service connector components into engagement.

19. The system according to claim 14, wherein one of the appliance and the substance communicating device comprises a proximity target and the other of the appliance and the substance communicating device comprises a proximity sensor that detects the proximity target when the proximity target is within a predetermined distance of the proximity sensor.

20. The system according to claim 14, wherein the service switch is operable by one of the first and second service connector components to selectively permit the communication of a plurality of services between the substance communicating device and the appliance through the service switch after the first and second service connector components are engaged.

21. The system according to claim 14, wherein the substance communicating device further comprises:

a main body;

a substance consumer associated with the main body; and a substance line having a first end coupled with the substance consumer and a second end coupled with the second service connector component.

22. The system according to claim 14, wherein the service switch and the actuator communicate using an electromagnetic service.

23. The system according to claim 22, wherein the appliance further comprises a first electromagnetic service connector component and the substance communicating device further comprises a second electromagnetic service connector component engageable with the first electromagnetic service connector component, wherein the service switch selectively permits the communication of electromagnetic service between the first and second electromagnetic service connector components and the service switch is activated when electromagnetic service is communicated between the first and second electromagnetic service connector components.

24. The system according to claim 14, wherein the service switch is configured to selectively permit the communication of an electromagnetic service between the substance communicating device and the appliance.

25. The system according to claim 24, wherein the first service connector component comprises a first substance communication connector component and a first electromagnetic service connector component, and the second service connector component comprises a second substance communication connector component and a second electromagnetic service connector component, the second service connector component being operably engageable with the first service connector component to permit the communication of a substance and the electromagnetic service between the first and second service connector components.

26. An accessory for use in conjunction with an appliance having a first electromagnetic connector component, a first switch component, and a first substance connector component, the accessory comprising:

a main body having a substance consumer;

a second electromagnetic connector component operably engageable with the first electromagnetic connector component to permit the communication of an electromagnetic service between the first and second electromagnetic connector components;

a second switch component configured to actuate the first switch component when the first electromagnetic connector component is adjacent the second electromagnetic connector component to permit the communication of the electromagnetic service between the accessory and the appliance; and a second substance connector component operably coupled with the substance consumer, the second substance connector component being operably actuatable by the communication of electromagnetic service between the first and second electromagnetic connector components to permit the communication of a substance between the first and second substance connector components;

wherein the first switch component operates upon the second switch component to draw the first and second electromagnetic connector components together to permit the communication of electromagnetic service.

27. The accessory according to claim 26 and further comprising a flow regulating component and a service line connecting the flow regulating component to the second electromagnetic connector component, wherein the flow regulating component is operable to regulate the flow of the substance in response to the communication of the electromagnetic service between the first and second electromagnetic connector components.

28. The accessory according to claim 27, wherein the flow regulating component comprises a valve.

29. The accessory according to claim 27, wherein the flow regulating component comprises a pump.

30. The accessory according to claim 27, and further comprising at least one of a dispenser, a filter, a water filter, an air filter, a detergent dispenser, a drink dispenser, a detergent cartridge, a bottle, a jug, a flavoring dispenser, a steam dispenser, a fragrance dispenser, a food ingredient dispenser, a cycle accessory, and a chemistry dispenser.

* * * * *